US007995768B2

(12) United States Patent
Miki et al.

(10) Patent No.: US 7,995,768 B2
(45) Date of Patent: Aug. 9, 2011

(54) SOUND REINFORCEMENT SYSTEM

(75) Inventors: Akira Miki, Hamamatsu (JP); Atsuko Ito, Hamamatsu (JP)

(73) Assignee: Yamaha Corporation (JP)

( * ) Notice: Subject to any disclaimer, the term of this patent is extended or adjusted under 35 U.S.C. 154(b) by 1504 days.

(21) Appl. No.: 11/342,019

(22) Filed: Jan. 27, 2006

(65) Prior Publication Data

US 2006/0165242 A1 Jul. 27, 2006

(30) Foreign Application Priority Data

Jan. 27, 2005 (JP) ..... 2005-019214
Jan. 27, 2005 (JP) ..... 2005-019215
Feb. 28, 2005 (JP) ..... 2005-052393
Mar. 7, 2005 (JP) ..... 2005-062084

(51) Int. Cl.
*H04R 29/00* (2006.01)
*H04R 3/00* (2006.01)

(52) U.S. Cl. ..... 381/59; 381/95; 381/96

(58) Field of Classification Search ..... 381/59, 381/95, 96, 73.1, 91, 92, 122, 102, 80–83, 381/85

See application file for complete search history.

(56) References Cited

U.S. PATENT DOCUMENTS 3,992,586 A * 11/1976 Jaffe ..... 381/83
4,837,829 A * 6/1989 Lobb ..... 381/83
5,233,664 A 8/1993 Yanagawa et al.
5,642,425 A * 6/1997 Kawakami ..... 381/63
5,778,082 A * 7/1998 Chu et al. ..... 381/92
6,317,501 B1 * 11/2001 Matsuo ..... 381/92
6,593,956 B1 * 7/2003 Potts et al. ..... 348/14.09
6,912,178 B2 * 6/2005 Chu et al. ..... 367/123
6,928,172 B2 * 8/2005 Ohta ..... 381/98
7,054,448 B2 * 5/2006 Yoshino et al. ..... 381/59
7,127,070 B2 * 10/2006 Kimura et al. ..... 381/56
7,143,649 B2 * 12/2006 Yoshino ..... 73/579
2005/0008169 A1 * 1/2005 Muren et al. ..... 381/92

FOREIGN PATENT DOCUMENTS

JP 58-56564 A 4/1983
JP 1-119296 U 8/1989
JP 2-292999 A 12/1990
JP 4-312098 A 11/1992
JP 5-41897 A 2/1993
JP 5-150792 A 6/1993
JP 9-65470 A 3/1997
JP 9-261792 A 10/1997
JP 10-243494 A 9/1998
JP 11-55784 A 2/1999
JP 2001-036998 A 2/2001

(Continued)

OTHER PUBLICATIONS

Office Action issued in corresponding Japanese patent application No. 2005-019214, mailed Oct. 7, 2008.

(Continued)

*Primary Examiner* — Xu Mei
(74) *Attorney, Agent, or Firm* — Rossi, Kimms & McDowell LLP

(57) ABSTRACT

A sound reinforcement system which enables handsfree and high-quality sound reinforcement without requiring a person who is speaking to move to a microphone or move a microphone. At least one microphone and a plurality of speakers are arranged in a room. A speaker output adjusting section outputs sound picked up by the microphone to the plurality of speakers at predetermined levels.

11 Claims, 15 Drawing Sheets

FOREIGN PATENT DOCUMENTS

JP 2003-250192 A 9/2003

OTHER PUBLICATIONS

"FS-03 Advanced Teleconference Interface;" manual by CTGaudio; pp. 1-17.

"Polycom Vortex Installed Voice Products," catalog by Polycom (2 pgs.).

Office Action mailed Apr. 8, 2008 issued in Corresponding Japanese Patent Application No. 2005-019214; English Translation Provided.

Office Action issued in corresponding Japanese patent application No. 2005-052393, dated Jun. 10, 2008.

Office Action issued in corresponding Japanese patent application No. 2005-062084, mailed Jul. 24, 2007.

* cited by examiner

SOUND SOURCE POSITION DETECTING SECTION
HA
A/D
Mixer
D/A
AMP
MIC1
MIC2
MICm
SP1
SP2
SP3
SPn
#1
#2
LEVEL/DELAY SETTING for MIC1
LEVEL/DELAY SETTING for MIC2
LEVEL/DELAY SETTING for MIC3
LEVEL/DELAY SETTING for MICm
MIC1 ON/OFF
MIC2 ON/OFF
MIC3 ON/OFF
MICm ON/OFF
from 2
LEVEL DELAY SETTING SECTION for MICi
MICi
delay
level
for SP1
SP2
SPn

SOUND REINFORCEMENT SYSTEM

BACKGROUND OF THE INVENTION

1. Field of the Invention

The present invention relates to a sound reinforcement system, and more particularly to a sound reinforcement system which can be suitably applied to small-to-medium conference rooms.

2. Description of the Related Art

When a person who is speaking and the audience are in the same room above a certain size, and the audience cannot hear sound made by the person who is speaking well only by real voice, the sound needs to be reinforced and made audible throughout the room.

In general, in the case where sound is reinforced, a person who speaks has to speak in front of a fixed microphone, or a person who is speaking carries a microphone so that clear sound can be picked up. When speakers are changed during, for example, a question-and-answer session, a person who asks questions has to move to a fixed microphone, or a microphone has to be moved to him/her.

In many cases, speakers concentrated at one point or arranged at dispersed locations on a ceiling are used to reproduce picked-up sound. However, in the case where speakers are concentrated at one point, picked-up sound is excessively reinforced in the vicinity of the speakers, and also, in the case where speakers are arranged at dispersed locations, picked-up sound is excessively reinforced in the vicinity of a person who is speaking. Thus, sound cannot be uniformly reinforced throughout a room.

In Japanese Laid-Open Patent Publication (Kokai) No. H09-65470, an acoustic system for use in temples is disclosed which reinforces sound picked up by a fixed microphone using speakers arranged at dispersed locations on the ceiling of a room, and sets the volume of the speakers to get smaller as they become closer to the microphone so that the total volume of real voice and reinforced sound from the speakers can be uniform throughout the room.

Also, a speaker's face direction recognizing method and apparatus is disclosed in Japanese Laid-Open Patent Publication (Kokai) No. H10-243494.

Also, in Japanese Laid-Open Patent Publication (Kokai) No. H11-055784, an indoor sound reinforcement system is disclosed which picks up sound made by a person who is speaking using a microphone array. By the use of the microphone array, a handsfree sound reinforcement system can be realized.

As described above, in the conventional sound reinforcement system, a person who is speaking has to move to a fixed microphone, or a microphone has to be moved to a person who is speaking.

Also, there has been proposed a method in which the volume of reinforced sound from speakers arranged at dispersed locations is controlled so as to make uniform the total volume of real voice and reinforced sound, but delays in the propagation of acoustic signals have not been taken into account.

Also, it has been difficult to reinforce sound of a plurality of channels due to a risk of howling.

In a sound reinforcement system in which sound picked up by a microphone is reinforced and output from speakers arranged at dispersed locations on a ceiling or the like, there may be cases where reinforced sound from speakers behind a listener is louder than reinforced sound from speakers in front of the listener depending on the positional relationship between a person who is speaking and the listener. In this case, the listener may feel discomfort.

For example, if the output levels of reinforced sound from speakers arranged on a ceiling are set to get higher as they become away from a person who is speaking, the sound reinforcement level is high at a location which sound cannot directly reach, i.e., a location away from the person who is speaking, and hence reinforced sound from behind a given listener is louder than reinforced sound from the person who is speaking (ahead of the listener). This causes the listener to feel discomfort since the sense of sight and the sense of hearing are inconsistent with each other.

Also, in a sound reinforcement system in which an input signal from a microphone is amplified and reinforced from speakers arranged in the same space such a conference room or a hall, sound from the speakers may pass to the microphone to form a closed loop, which causes howling.

To prevent such howling, howling is detected and the gain of sound reinforcement is manually or automatically decreased, or a howling canceller that estimates the transfer function of the closed loop and performs signal processing is used.

Also, in the indoor sound reinforcement system disclosed in Japanese Laid-Open Patent Publication (Kokai) No. H11-055784, sound made by a person who is speaking is picked up using a microphone array, reinforced, and output from a plurality of speakers into a room, and which decreases the gains of speakers in the vicinity of the person who is speaking so as to prevent sound emitted from the speakers from being picked up by the microphone array to form the closed loop when the directivity of the microphone array is directed toward the person who is speaking in the vicinity of the speakers.

Regarding the sound reinforcement system for use in a conference room, hall, or the like, there may be cases where microphones of two or more channels are used at the same time and in the same room due to the presence of a person who speaks and persons who ask questions. In such a case, a plurality of acoustic paths exist, and hence howling is likely to occur.

Referring to FIG. 1, a description will now be given of an example in which sound inputs from a plurality of microphones are reinforced. In this example, it is assumed that a plurality of microphones and a plurality of speakers are arranged at dispersed locations on a ceiling.

In FIG. 1, when a person A is speaking, a microphone of one channel is used. Specifically, sound made by the person A is picked up by a microphone MICa located in the vicinity of the person A, amplified, and reproduced from a speaker SPb away from the person A. As a result, even a listener away from the person A can hear the sound made by the person A at a satisfactory volume level.

If a person B starts speaking while the person A is speaking, sound is reinforced using microphones of two channels. Specifically, sound made by the person B is picked up by a microphone MICb located in the vicinity of the person B as well as the above-mentioned microphone MICa that picks up sound made by the person A, amplified, and reproduced from e.g. a speaker SPa away from the person B.

On this occasion, a closed loop is formed as shown in FIG. 1 because sound made by the person A is picked up by the microphone MICa, amplified, and reinforced from the speaker SPb, and the resultant sound-reinforced signal passes to the microphone MICb that picks up sound made by the person B, is amplified, and is reinforced from the speaker SPa located in the vicinity of the person A, and the resultant sound-reinforced signal passes to the microphone MICa located in the vicinity of the person A. When the gain of this closed loop is greater than 1, howling occurs.

Conventionally, to prevent such howling, the gain of sound reinforcement is adjusted by a special operator. Also, when the gain of sound reinforcement is decreased for the purpose of preventing howling, sound cannot be reinforced at a satisfactory level.

Further, signal processing using a howling canceller as described above has also been known, but this is not effective since the transfer function cannot be estimated where microphones of a plurality of channels are used, although this is effective in the case where a microphone of only one channel is used. Also, to accommodate a plurality of channels, a complicated and expensive system is required.

SUMMARY OF THE INVENTION

It is a first object of the present invention to provide a sound reinforcement system that enables handsfree and high-quality sound reinforcement without requiring a person who is speaking to move to a microphone or move a microphone.

It is a second object of the present invention to provide a sound reinforcement system that prevents howling using a simple configuration when a plurality of microphones are used.

It is a third object of the present invention to provide a sound reinforcement system that uses a plurality of speakers arranged at dispersed locations on a ceiling or the like and enables natural sound reinforcement that does not cause the audience to feel discomfort.

To attain the above object, in a first aspect of the present invention, there is provided a sound reinforcement system comprising at least one microphone disposed in a room, a plurality of speakers disposed in the room, and a speaker output adjusting device that outputs sound picked up by the microphone to the plurality of speakers at predetermined levels.

With this sound reinforcement system, handsfree and high-quality sound reinforcement can be realized without requiring a person who is speaking to move to a microphone or move a microphone.

Preferably, the sound reinforcement system further comprises a sound source position detecting device that selects a microphone corresponding to a sound source position based on input signals from the plurality of microphones, and each of the plurality of microphones has a limited directivity, each of the plurality of speakers has a limited directivity, and the speaker output adjusting device adjusts gains and delay times for an input signal input from a microphone corresponding to the sound source position selected by the sound source position detecting device depending on distances between the microphone and respective ones of the plurality of speakers and output the input signal to the plurality of speakers.

With this sound reinforcement system, a microphone corresponding to a sound source position (the position of a person who is speaking) is selected from among a plurality of microphones, and sound made by the person who is speaking is picked up by the microphone corresponding to the sound source position. AS a result, the person who is speaking does not have to carry a microphone.

Also, the output level and the delay time are controlled with respect to an input signal from a microphone corresponding to a sound source position, and the resultant reinforce signals are output from the plurality of speakers. As a result, sound can be reinforced uniformly throughout a room.

Further, when a new sound source position is detected, microphones that pick up sound are changed, and accordingly, the output levels and delay times of signals to be reinforced from the speakers are changed. As a result, even when the person who is speaking moves, sound can be reinforced uniformly.

Furthermore, by limiting the directivities of the microphones and the speakers, even in the same room, sound reinforcement using plurality of channels can be realized at the same time.

More preferably, the sound reinforcement system further comprises a speaker's face direction detecting device that detects a direction of a face of a person who is speaking based on input signals from the plurality of microphones, and the speaker output adjusting device adjusts gains, delay times, and frequency characteristics for an input signal input from a microphone corresponding to the sound source position selected by the sound source position detecting device in accordance with at least one of distances between the microphone and respective ones of the plurality of speakers and the direction of the face detected by the speaker's face direction detecting device and output the input signal to the plurality of speakers.

With this sound reinforcement system, the output level, delay time, and frequency characteristics are adjusted with respect to an input signal from a microphone corresponding to a sound source position in accordance with at least one of the distances between the microphone and the plurality of speakers and the direction of the face of the person who is speaking, and the resultant signals are output from the plurality of speakers. Since sound is reinforced in this manner, sound can be reinforced naturally and uniformly throughout a room.

Preferably, the sound reinforcement system further comprises a sound source position detecting device that selects a microphone corresponding to a sound source position based on input signals from the plurality of microphones, the speaker output adjusting device adjusts gains and delay times for an input signal input from a microphone corresponding to the sound source position selected by the sound source position detecting device depending on distances between the microphone and respective ones of the plurality of speakers and output the input signal to the plurality of speakers, and when a microphone corresponding to a new sound source position is selected in the state in which the microphone corresponding to the sound source position has been selected by the sound source position detecting device, an output level of a speaker located in a vicinity of the microphone corresponding to the newly selected sound source position is lowered.

With this sound reinforcement system, the gain of sound reinforcement is controlled in a manner reflecting the rules of interaction by a plurality of persons who are speaking. As a result, it is unnecessary to perform special signal processing, and it is possible to prevent howling when a plurality of microphones are used.

Also preferably, the sound reinforcement system further comprises a directivity control device that sets directivity axes of sound emitted from respective ones of the plurality of speakers in directions opposite to a sound source direction.

With this sound reinforcement system, reinforced sound from speakers behind listeners does not reach the listeners, and the listeners hear sound from the front (i.e., from the direction of a person who is speaking). Thus, the listeners do not feel discomfort.

Also, when a person who is speaking moves, or when a plurality of persons are speaking at the same time, the listeners can hear sound without feeling discomfort.

Preferably, the sound reinforcement system further comprises a sound source position detecting device that detects a position of a sound source, and the directivity control device controls directivity axes of sound emitted from the respective ones of the plurality of speakers to be oriented in directions opposite to the direction of the sound source detected by the sound source position detecting device.

Also preferably, the plurality of microphones are arranged at dispersed locations on a ceiling, the sound reinforcement system further comprises a sound source position detecting device that selects a microphone corresponding to a sound source position based on input signals from the plurality of microphones, and the directivity control device controls directivity axes of sound emitted from the respective ones of the plurality of speakers to be oriented in directions opposite to the direction of the microphone corresponding to the sound source position selected by the sound source position detecting device.

Preferably, the sound source position detecting device is capable of selecting each of the plurality of microphones as a corresponding one of microphones corresponding to a plurality of sound source positions, and the directivity control device controls directivity axes of sound emitted from the respective ones of the plurality of speakers to be oriented in directions opposite to the directions of the respective microphones selected as the microphones corresponding to the plurality of sound source positions selected by the sound source position detecting device.

Preferably, the plurality of speakers each comprise a plurality of speaker units and is speaker array of which directivity is capable of being controlled by controlling a signal for each of the speaker units, individually, and the directivity control device controls directivities of respective ones of the speaker arrays.

Preferably, the plurality of microphones and the plurality of speakers are arranged at dispersed locations on a ceiling.

Preferably, the plurality of microphones and the plurality of speakers are arranged on a surface of the ceiling.

Also preferably, the plurality of microphones and the plurality of speakers are suspended from the plurality of supporting sections provided on a surface of the ceiling.

Preferably, the speaker output adjusting device is capable of adjusting input signals from the plurality of microphones with respect to each channel of the input signals, and simultaneously adding the adjusted input signals and outputting the resultant signals to the plurality of speakers.

Preferably, the gains and the delay times are set in proportion to distances from the microphone corresponding to the sound source position selected by the sound source position detecting device to respective ones of the plurality of speakers.

The above and other objects, features, and advantages of the invention will become more apparent from the following detained description taken in conjunction with the accompanying drawings.

BRIEF DESCRIPTION OF THE DRAWINGS

FIGS. 13A and 13B are block diagrams showing the configuration of the sound reinforcement system in FIG. 12, in which:

FIG. 13A shows the entire configuration of the sound reinforcement system; and FIG. 13B shows the configuration of an output level/directivity controller of the sound reinforcement system;

DETAILED DESCRIPTION OF THE PREFERRED EMBODIMENTS

The present invention will now be described in detail with reference to the drawings showing preferred embodiments thereof.

Figure 1:
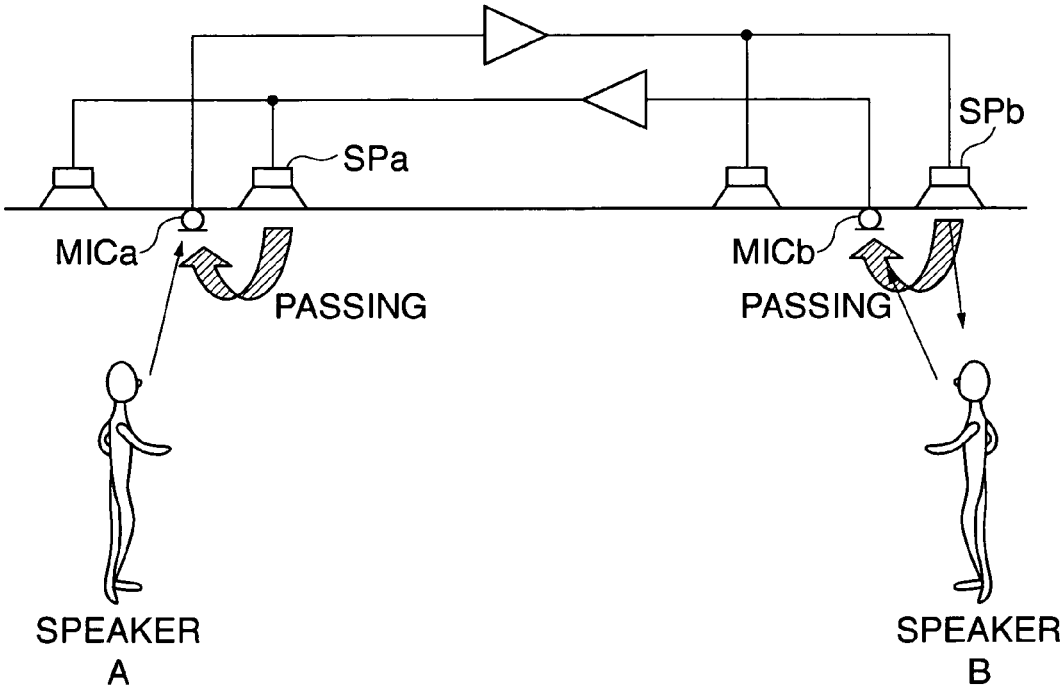
FIG. 1 PRIOR ART
FIG. 1 is a view useful in explaining howling that occurs when microphones of a plurality of channels are used in a conventional sound reinforcement system.
Figure 2:
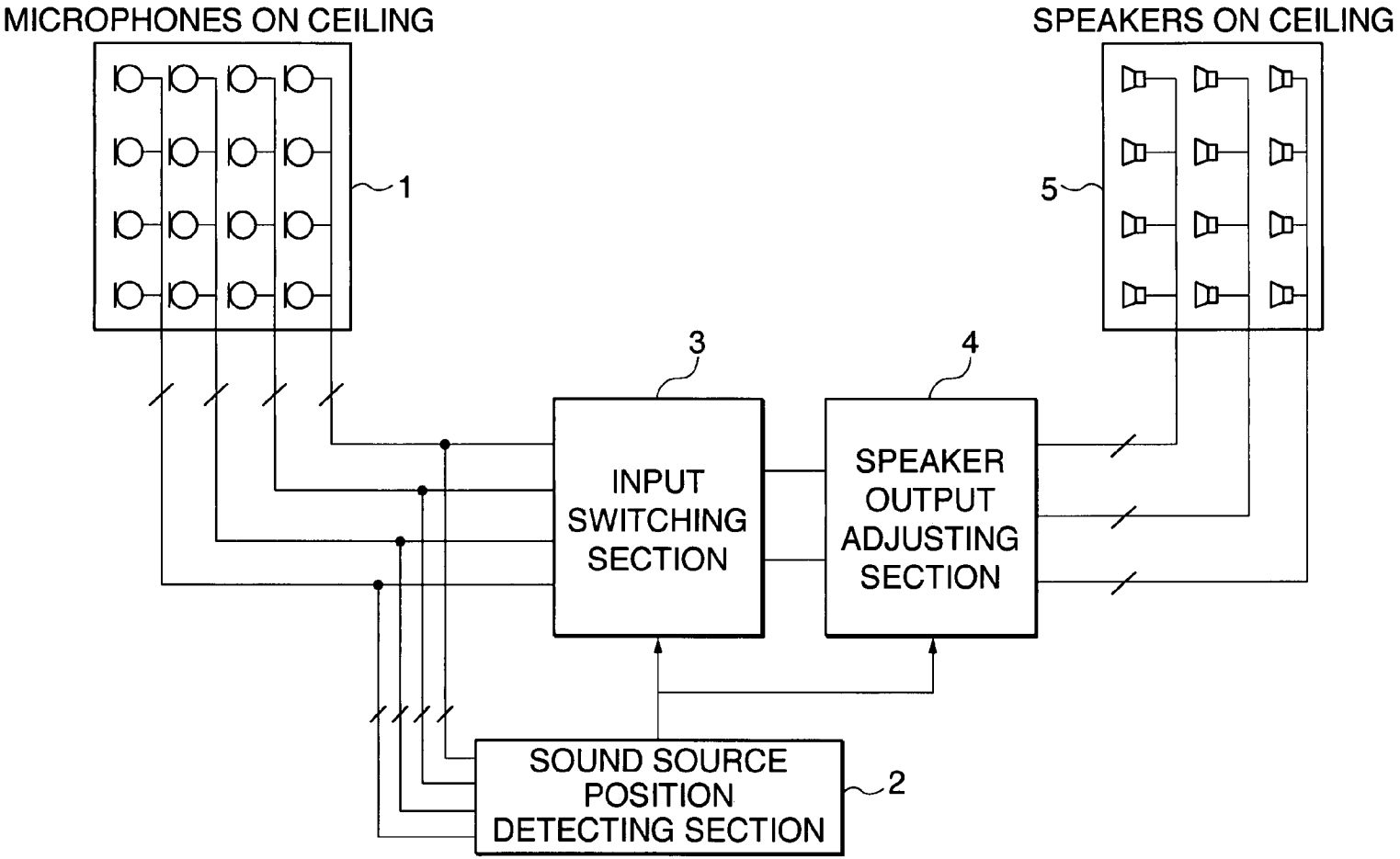
FIG. 2 is a block diagram schematically showing the configuration of a sound reinforcement system according to a first embodiment of the present invention.

FIG. 2 is a block diagram showing the overall configuration of a sound reinforcement system according to a first embodiment of the present invention. This sound reinforcement system can be suitably applied to small-to-medium sized conference rooms or the like where all the listeners cannot hear speech well only by speaker's real voice.

In FIG. 2, reference numeral 1 denotes a plurality of (m) microphones arranged at dispersed locations on the ceiling of a room equipped with the sound reinforcement system according to the present invention, and reference numeral 5 denotes a plurality of (n) speakers arranged at dispersed locations on the ceiling similarly to the microphones. Each of the microphones 1 (MIC1 to MICm) has a directivity that is limited to pick up sound only within an area in its vicinity, and the m microphones 1 arranged at dispersed locations on the ceiling cover the entire room. Similarly, each of the speakers 5 (SP1 to SPn) has a directivity that is limited to reinforce sound within an area in its vicinity, and the n speakers 5 arranged at dispersed locations on the ceiling cover the entire room. The space between the microphones 1 and the space between speakers 5 are determined by their directivities and the height of the ceiling. It is, however, preferred that the microphones 1 and the speakers 5 are arranged as far apart as possible.

The speakers 5 may be implemented by flat speakers, or may be used as part of a system ceiling.

In FIG. 2, reference numeral 2 denotes a sound source position detecting section that detects the position of a person who is speaking by monitoring the levels of input signals from the respective microphones 1 (MIC1 to MICm), and outputs a control signal to an input switching section 3 and a speaker output adjusting section 4. The input switching section 3 selects a signal from a microphone MICi corresponding to the position of the person who is speaking in accordance with the signal from the sound source position detecting section 2. The speaker output adjusting section 4 controls the output level and the delay for each of the speakers 5 with respect to the signal selected by the input switching section 3, and outputs the resulting signals to the respective speakers 5 (SP1 to SPn).

The sound source position detecting section 2 monitors input signals from the plurality of microphones 1 (MIC1 to MICm), and determines that a position of a microphone MICi from which an input signal of the highest level among input signals with levels equal to or higher than a predetermined level is a sound source position (speaker's position). If the person stops speaking and no input signal with a level equal to or higher than the predetermined level is output from the microphones (MIC1 to MICm), the sound source position detecting section 2 determines that there is no sound source position.

Also, the sound source position detecting section 2 outputs a control signal for setting output levels and delay times (delays) of signals to be output from the respective speakers 5 (SP1 to SPn) to the speaker output adjusting section 4 so that the sound pressure level at a listening height can be the same at any location in the room when the input signal from the microphone MICi regarded as the sound source position is reinforced and output from the speakers 5 (SP1 to SPn).

Here, the output levels of signals from the respective speakers 5 are determined so that the sum of a direct sound from the person who is speaking and a reinforced sound from the corresponding speaker can be the same at any location in the room. That is, the output level of speakers away from a sound source position is controlled so as to compensate for the amount of distance attenuation of a direct sound. The output levels of signals from the respective speakers 5 may be computed based upon the distances between a sound source position (the position of a microphone) and the respective speakers 5, or may be determined by referring to a table prepared in advance on which output levels for the respective speakers 5 are recorded with respect to each sound source position.

The delays are intended to assign delay times corresponding to times needed for a direct tone emitted from a sound source position to reach the respective speakers to sound-reinforced signals to be output from the respective speakers. The delays may be calculated based upon the distance between a sound source position (the position of a microphone) and the respective speakers 5, or may be determined by referring to a table prepared in advance on which delays times for the respective speakers 5 are recorded with respect to each sound source position.

Based upon an output signal from the sound source position detecting section 2 (i.e., a signal that designates a microphone detected as a sound source position), the input switching section 3 selects an input signal from the microphone and outputs the selected input signal to the speaker output adjusting section 4.

Based upon a control signal from the sound source detecting section 2, the speaker output adjusting section 4 sets output levels and delays of signals to be output to the respective speakers 5 with respect to the input signal selected by the input switching section 3.

When the person who has been speaking stops speaking, no signal that designates the sound source position is output from the sound source position detecting section 2, and hence the input switching section 3 outputs no input signal to the speaker output adjusting section 4.

When another person has started speaking, the sound source position detecting section 2 determines that a microphone MICj in the vicinity of the person who has started speaking is a sound source position, and outputs a signal that identifies the microphone MICj to the input switching section 3. As a result, an input signal from the microphone MICj is supplied to the speaker output adjusting section 4, and sound-reinforced signals of which output levels and delays have been set in accordance with the sound source position being the microphone MICj are output from the respective speakers 5.

When a plurality of persons are speaking at the same time and there are a plurality of sound source positions, sound of a plurality of channels can be reinforced at the same time. A description will now be given of an example in which sound of two channels is reinforced. In the case where signals with levels equal to or higher than a predetermined level are input from two microphones MICi and MICj when input signals from the plurality of microphones 1 (MIC1 to MICm) are being monitored, it is determined that these two microphones MICi and MICj are sound source positions, and the microphones MICi and MICj are turned on (i.e., the input signals from the MICi and MICj are selected). If the person who is speaking in the vicinity of the microphone MICi stops speaking and there is no input signal with a level equal to or higher than the predetermined level from the microphone MICi, it is determined that the sound source at the microphone MICi disappears, and the microphone MICi is turned off. Also, when a signal with a level equal to or higher than a predetermined level is input from another microphone MICk after it is determined that the sound source has disappeared, it is determined that the sound source has moved to the microphone MICk or a new sound source appears, the microphone MICk is turned on. When there are a plurality of sound sources, the output level and the delay is controlled for each of the speakers 5 so that sound can be reinforced with the sound pressure level being the same at any location in the room, similarly to the above described case of one channel. In this case, the input switching section 3 selects input signals from a plurality of (for example, two) microphones, and the speaker output adjusting section 4 capable of processing signals of a plurality of channels controls levels and delays of signals to be output to the respective speakers with respect to each of the input signals, and adds together output signals of the plurality of channels and outputs the resultant signal to each speaker.

As described above, according to the present invention, the microphones and the speakers have limited directivities (narrow directivity angles). Also, outputs from speakers in the vicinity of a selected microphone are adjusted to be small and outputs from speakers away from the microphone are adjusted to be large. As a result, inputs from a plurality of microphones can be reinforced at the same time at low risk of howling. It should be noted that speakers in the vicinity of a selected microphone correspond to speakers which are located in an area in which, when sound picked up by the selected microphone is reinforced and output from the speakers, the reinforced sound may pass to the selected microphone to form a closed loop, which causes howling.

Figures 3A, 3B:
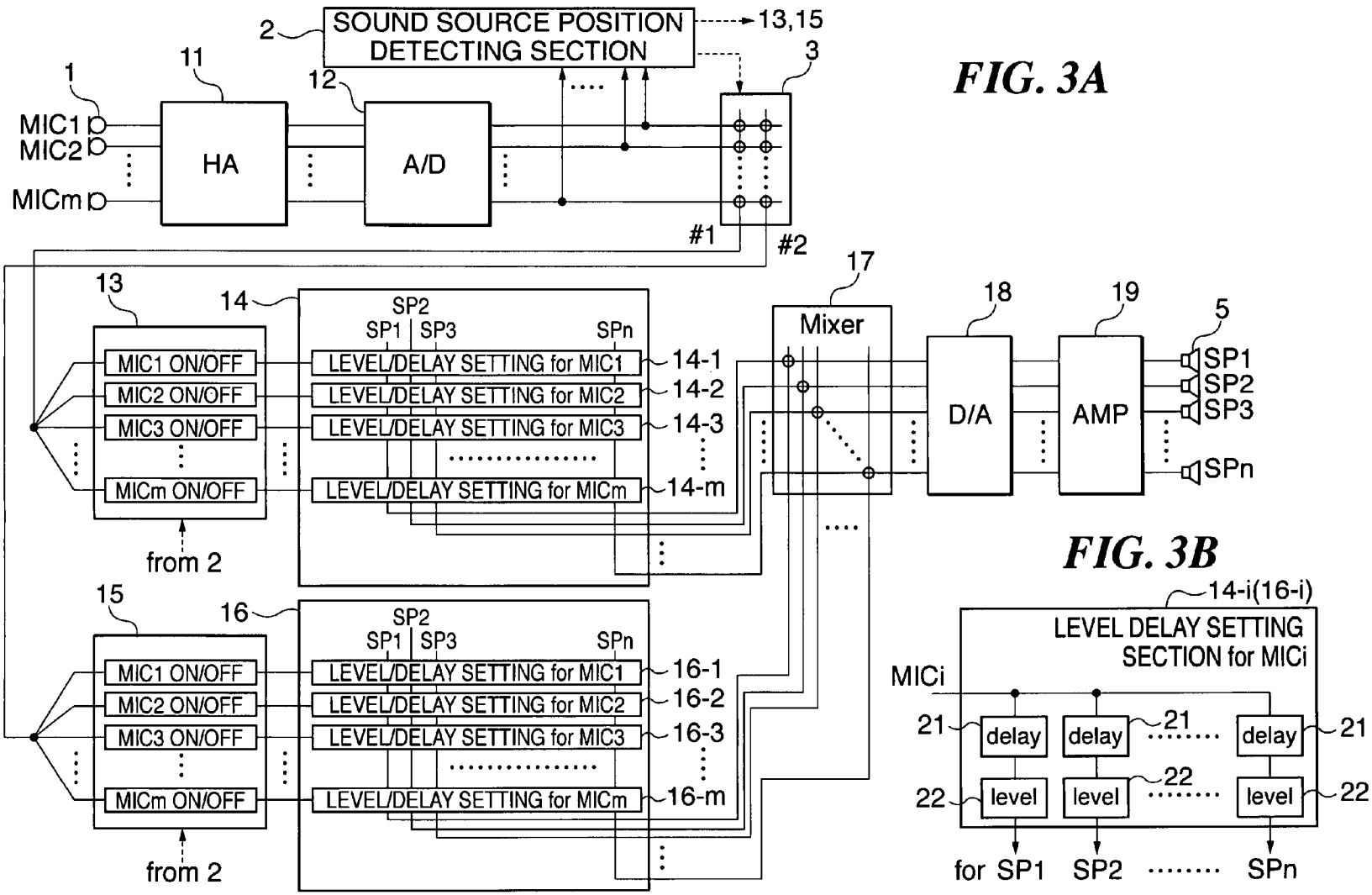
FIG. 3A is a block diagram showing the configuration of the sound reinforcement system in FIG. 1 more concretely.
FIG. 3B is a partially enlarged diagram showing a level/delay setting section appearing in FIG. 3A.

FIG. 3A is a block diagram showing the configuration of the sound reinforcement system according to the first embodiment of the present invention more concretely. In the sound reinforcement system in FIG. 3A, input signals of up to two channels can be processed at the same time.

In FIG. 3A, component elements corresponding to those in FIG. 2 referred to above are denoted by the same reference numerals, and description thereof is omitted.

Input signals of sounds picked up by the plurality of microphones 1 (MIC1 to MICm) arranged at dispersed locations on the ceiling as described above are amplified by head amplifier groups 11 and then converted into digital data by an A/D converter 12, respectively. The input signals from the respective microphones 1 are output from the A/D converter 12 and input to the sound source position detecting section 2 to detect a sound source position. Specifically, it is determined that a person who is speaking lies in an area in the vicinity of a microphone (area in which the microphone can pick up sound) from which a signal with the highest level is input among input signals with levels equal to or higher than a predetermined level, and the location of the microphone (MICi) corresponds to a sound source position.

The sound source position detecting section 2 outputs information that designates the microphone determined as being the sound source position to the input switching section 3 as well as switch groups 13 and 15 and output level/delay setting sections 14 and 16, described later.

The input switching section 3 has first and second outputs of two channels designated by #1 and #2 (see FIG. 3A), and selectively connects an input signal from a microphone determined as being a sound source position by the sound source position detecting section 2 to either of the two outputs. For example, with respect to a sound source position detected first, the input switching section 3 connects an input signal from the corresponding microphone to the first output #1, and when a second person who is speaking is then detected, the input switching section 3 connects an input signal from the corresponding microphone to the second output #2.

The switch group 13 and the output level/delay setting section 14 control the output level and the delay time for each of the speakers 5 arranged at dispersed locations with respect to an input signal supplied via the first output #1 of the input switching section 3, and output the resultant signals to the respective speakers 5. The switch group 13 is controlled to be turned on/off according to which microphone has output the input signal. The output level/delay setting section 14 is a speaker output adjusting section that controls the output level and the delay (delay times) for each of the speakers 5 with respect to an input signal from each of the microphones.

Similarly, the switch group 15 is provided in association with the second output #2 of the input switching section 3, and the output level/delay setting section 16 is a speaker output adjusting section that controls the output level and the delay (delay time) for the respective speakers with respect to an input signal from a microphone selected by the switch group 15.

An input signal from the first output #1 of the input switching section 3 (a signal of sound picked up by the microphone MICi) is supplied to the corresponding level/delay setting section 14-*i* of the output level/delay setting section 14 via the switch group 13. Specifically, in the switch group 13, a switch (i.e., a switch for the microphone MICi) associated with a microphone at a sound source position is turned on based upon information from the sound source position detecting section 2, which is indicative of the designation of the microphone at the sound position, and switches corresponding to the other microphones are kept off. As a result, a signal of sound picked up by the microphone MICi and input via the first output #1 of the input switching section 3 is supplied to the level/delay setting section 14-*i* of the output level/delay setting section 14, which is associated with the microphone (MICi) at the sound source position, via the turned-on switch in the switch group 13.

As shown in FIG. 3A, the output level/delay setting section 14 is comprised of level/delay setting sections 14-1 to 14-*m* associated with the respective microphones 5. As shown in FIG. 3B, each level/delay setting section 14-*i* is comprised of delay processing sections 21 that assign time delays corresponding to the distances between a microphone at a sound source position and the respective speakers (SP1 to SPn), and level control sections 22 that control output levels so as to compensate for the distance attenuation of sound (direct sound) from the sound source position corresponding to the distances between the microphone at the sound source position and the respective speakers (SP1 to SPn). Thus, an input signal from the microphone MICi is supplied to the corresponding level/delay setting section 14-*i* connected to a turned-on switch of the switch group 13, and the input signal is subjected to delay control and output level control corresponding to a position of each speaker and then output. In each delay processing section 21, a delay time corresponding to a delay time in the propagation of a signal of sound from the corresponding microphone to the corresponding speaker is set. In each level control section 22, a gain of reinforced sound for output from the corresponding speaker is set so that the sum of a direct sound that reaches listeners in the vicinity of the corresponding speaker and a reinforced sound output from the speaker can be the same at any location in the room irrespective of speakers' positions.

As described above, according to the present embodiment, the level/delay setting sections 14-1 to 14-*m* in each of which output levels and delays of signals to be output to the respective speakers 5 are set in advance according to a position of each speaker 5 for the respective microphones 1 are provided, and a signal from a microphone selected by the switch group 13 is supplied to a level/delay setting section of the level/delay setting sections 14-1 to 14-*m* corresponding to the selected microphone.

When a second person starts speaking and the sound source position detecting section 2 detests a second sound source position, control is carried out such that information indicative of a microphone (referred to as a microphone MICj) corresponding to the second sound source position is supplied from the sound source detecting section 2 to the input switching section 3, and an input signal from the microphone (MICj) is connected to the second output #2 of the input switching section 3.

The input signal output via the second output #2 is supplied to the switch group 15 for the second channel configured in the same manner as the switch group 13 for the first channel, and a switch corresponding to the microphone (MICj) corresponding to the second sound source position is turned on, and the input signal from the microphone MICj is supplied to a corresponding level/delay setting section 16-*j*. The output level/delay setting section 16 identical in configuration with the output level/delay setting section 14 for the first channel controls the output level and the delay for each of the speakers 5 with respect to the input signal from the microphone MICj in response to speaking by the second person.

Signals of which output levels and delay times have been set for the respective speakers with respect to the input signal from the microphone MICi by the output level/delay setting section 14, and signals of which output levels and delay times have been set for the respective speakers with respect to the input signal from the microphone MICj by the output level/delay setting section 16 are added together by a mixer 17, converted into respective analog signals by a D/A converter 18, power-amplified by an amplifier 19, respectively, and output from the respective corresponding speakers 5 (SP1 to SPn).

As a result, speech made by a person who is speaking can be heard to at the same volume level at any location in the room.

Figure 4:
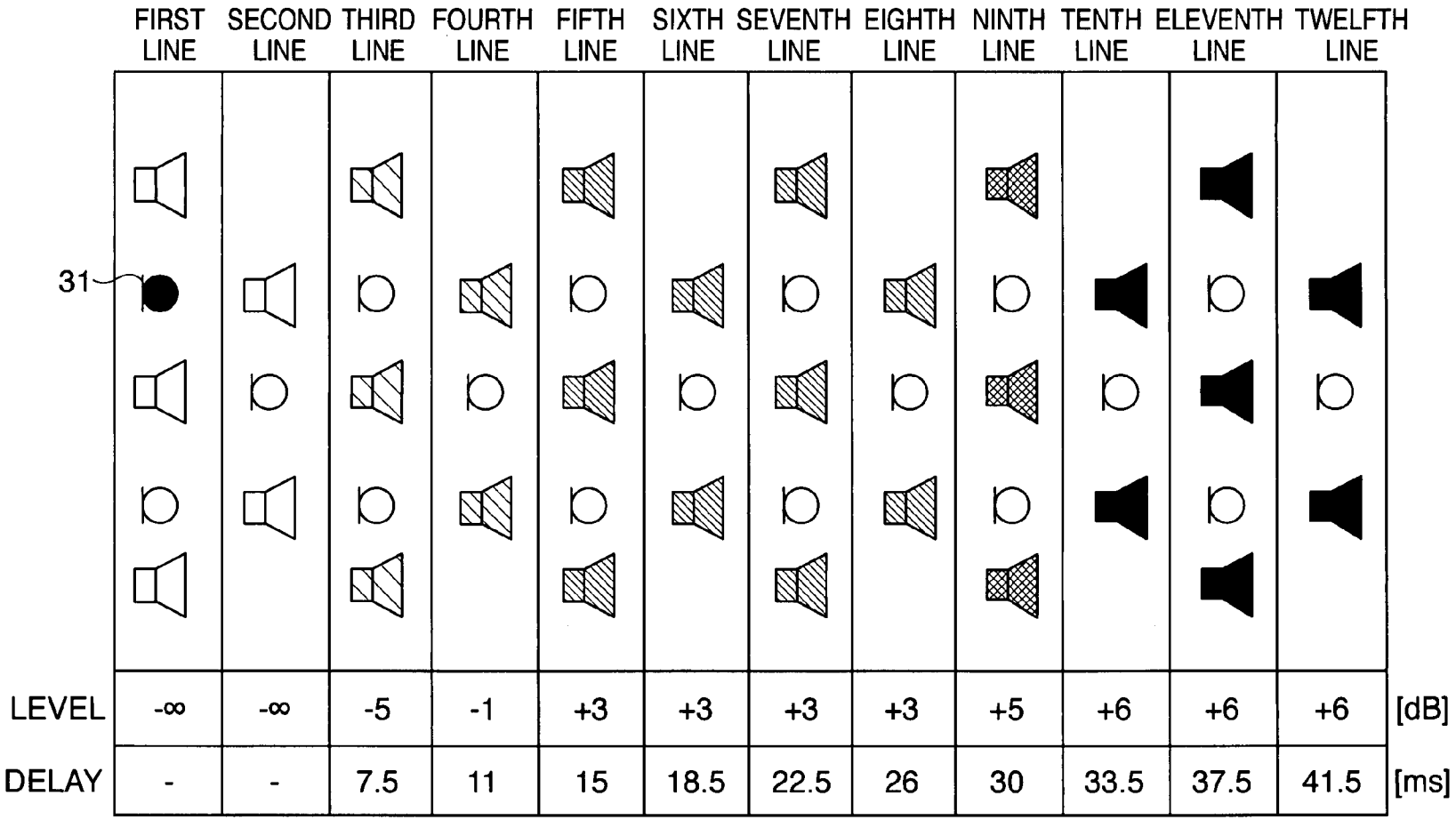
FIG. 4 is a diagram showing examples of set output levels and delays of signals output from respective speakers in the sound reinforcement system in FIG. 3A.

FIG. 4 is a diagram showing an example in which delay times and output levels of signals to be output from the respective speakers 5 are set by the output level/delay setting section 14.

In the illustrated example, it is assumed that the location of a microphone 31 is determined as being a sound source position. On this occasion, an output level of $-\infty$ (not output) and a delay of 0[ms] are set for signals to be output to speakers arranged in the vicinity of the microphone 31 at (corresponding to) the sound source position (i.e., in first and second lines), and delays and output levels proportional to the distance from the microphone 31 are set for signals to be output to speakers away from the microphone 31.

As a result, speech can be heard at the same volume level at any location in the room.

Although in the example shown in FIG. 4, delays and output levels are set with respect to each line in which speakers are arranged so that the processing load can be reduced, this is not limitative, but delays and output levels may be set with respect to each speaker, more precisely.

Figure 5:
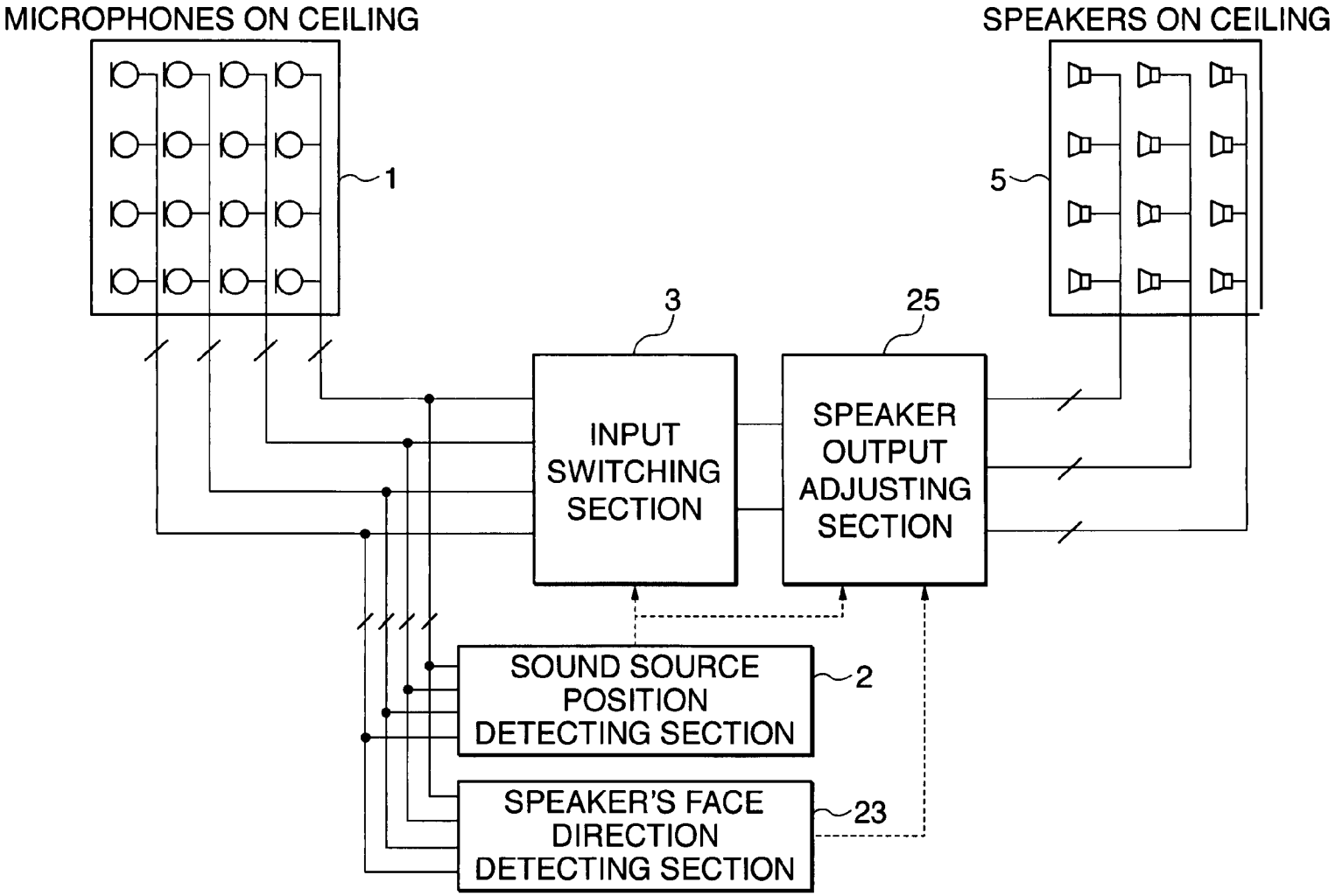
FIG. 5 is a block diagram schematically showing the configuration of a sound reinforcement system according to a second embodiment of the present invention.
Figure 6A:
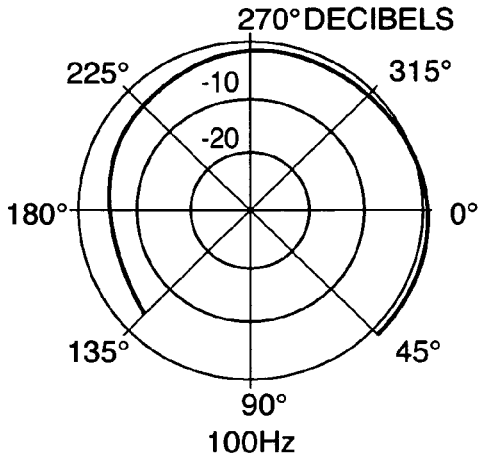
FIGS. 6A to 6E are diagrams showing directional patterns of human voice in a vertical plane that symmetrically divides the mouth with respect to five frequencies.
Figure 6B:
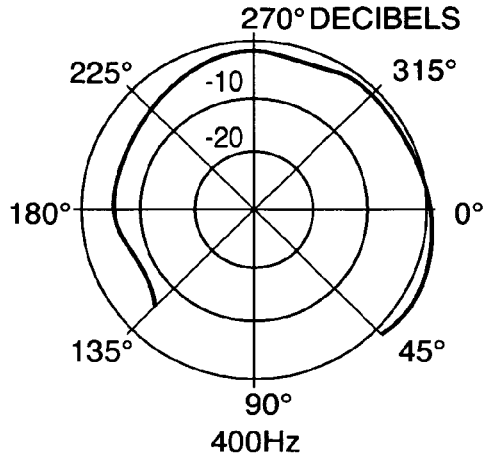
Figure 6C:
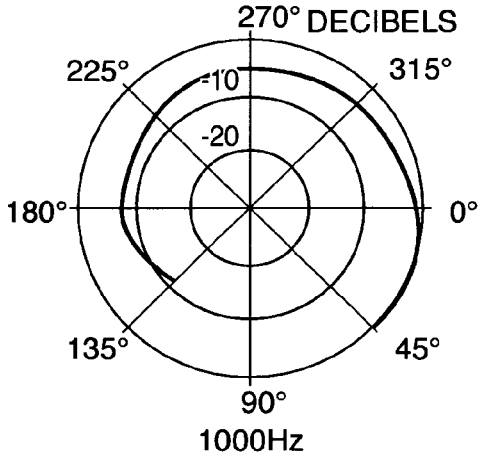
Figure 6D:
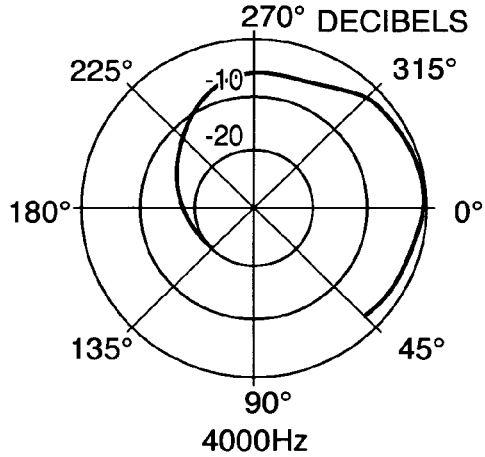
Figure 6E:
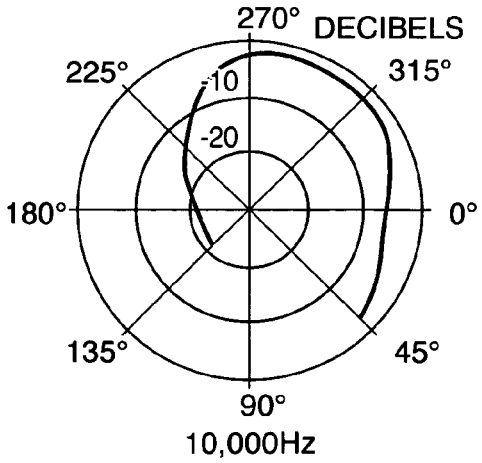

FIG. 5 is a block diagram showing the overall configuration of a sound reinforcement system according to a second embodiment of the present invention. The sound reinforcement system according to the second embodiment can be suitably applied to small-to-medium sized conference rooms or the like where all the listeners cannot hear speaker's speech well only by speaker's real voice.

In the sound reinforcement system according to the present embodiment, component elements corresponding to those of the sound reinforcement system according to the above described first embodiment are denoted by the same reference numerals, and description thereof is omitted.

In FIG. 5, reference numeral 23 denotes a speaker's face direction detecting section that detects the direction of the face of a person who is speaking by using frequency-specific signal levels of input signals from the respective microphones 1 and outputs a control signal to a speaker output adjusting section 25. With respect to a signal selected by the input switching section 3, the speaker output adjusting section 25 controls the output level and the delay for signals to be output to the respective speakers SPj (j=1 to n), adds frequency characteristics to the respective signals based upon a control signal from the speaker's face direction detecting section 23, and outputs the resultant signals to the respective speakers 5 (SP1 to SPn).

The speaker's face direction detecting section 23 detects frequency band-specific signal levels of input signals from the respective microphones 1 (MIC1 to MICm), and detects the direction of the face of a person who is speaking from a pattern of the detected signals.

FIGS. 6A to 6E are diagrams showing directional patterns of human voice with respect to five frequencies (100 Hz, 400 Hz, 1,000 Hz, 4,000 Hz, and 10,000 Hz) in a vertical plane that symmetrically divides the mouth. In FIGS. 6A to 6E, the direction of 0° corresponds to the direction of the front of the mouth, and the direction of 270° corresponds to the direction of the top of the head.

As shown in FIGS. 6A to 6E, the amount of voice that reaches the rear decreases as the frequency of the voice increases.

Thus, the speaker's face direction detecting section 23 monitors frequency-specific signal levels of signals input from the plurality of microphones 1, and then, determines the direction of the face of a person who is speaking from a pattern of the signals levels.

The speaker's face direction detecting section 23 determines the direction of the face of a person who is speaking from a pattern of frequency-specific signal levels of input signals from the plurality of microphones 1 (MIC1 to MICm), and outputs a control signal to the speaker output adjusting section 25 in accordance with the determination result so that sound-reinforced signals with high frequencies thereof enhanced are output from speakers located behind the person who is speaking. In this case, control signals associated with directions of faces and distances from microphones at sound source positions may be stored in advance in a table, and then, a suitable control signal may be read out from the table in accordance with a detected direction of a face and a detected sound source position and then output to the speaker output adjusting section 25.

It should be noted that the direction of the face of a person who is speaking may be detected with higher accuracy by making reference to frequency-specific directional patterns of human voice in a horizontal plane in addition to the directional patterns in the vertical plane shown in FIGS. 6A to 6E.

Based upon an output signal from the sound source position detecting section 2 (i.e., a signal that designates a microphone detected as a microphone corresponding to a sound source position), the input switching section 3 selects an input signal from the microphone and outputs the same to the speaker output adjusting section 25.

Based upon control signals from the sound source detecting section 2 and the speaker's face direction detecting section 23, the speaker output adjusting section 25 sets output levels, delays, and frequency characteristics of signals to be output to the respective, speakers 5 with respect to the input signal selected by the input switching section 3.

When the person who has been speaking stops speaking, no signal that designates the sound source position is output from the sound source position detecting section 2, and the input switching section 3 outputs no input signal to the speaker output adjusting section 25.

When another person has started speaking, the sound source position detecting section 2 determines that a position of a microphone MICj in the vicinity of the person who has started speaking is a sound source position, and outputs a signal that identifies the microphone MICj to the input switching section 3. As a result, an input signal from the microphone MICj is supplied to the speaker output adjusting section 25, and sound-reinforced signals of which output levels and delays have been set in accordance with the sound source position corresponding to the microphone MICj and which have frequency characteristics in accordance with the direction of the face of the person who has started speaking detected by the speaker's face direction detecting section 23 are output from the respective speakers 5.

Figure 7:
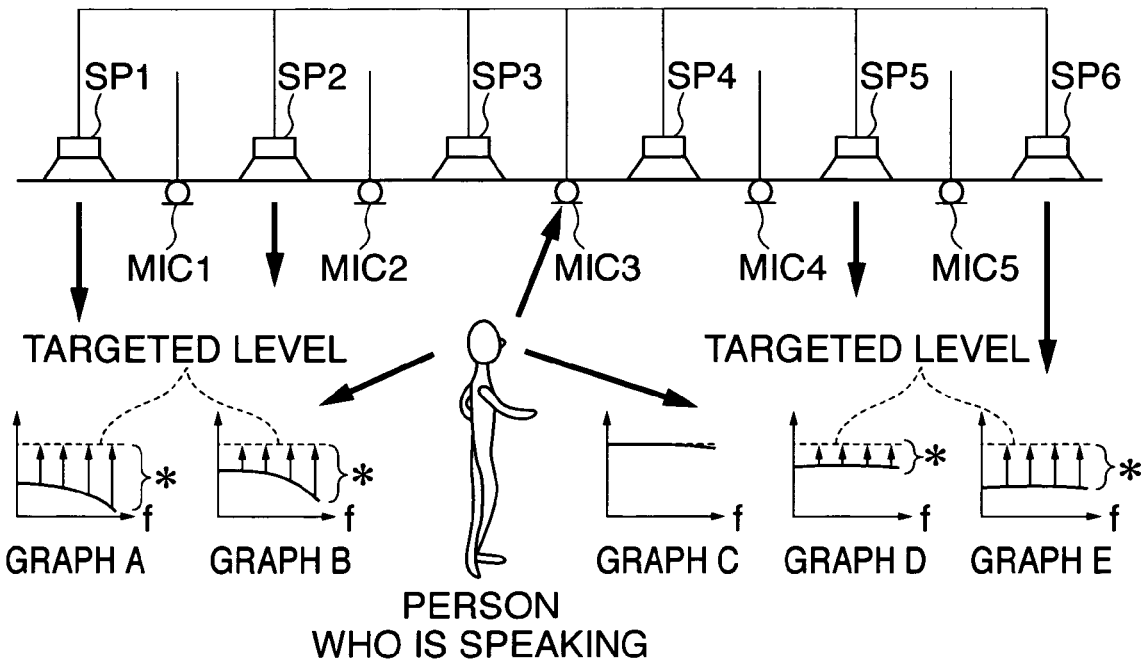
FIG. 7 is a diagram schematically showing the operation of the sound reinforcement system in FIG. 5.

FIG. 7 is a diagram schematically showing the operation of the sound reinforcement system according to the present embodiment.

In FIG. 7, graphs A to E show examples of signal levels of direct incoming waves at locations in front of and behind a person who is speaking. At the locations A and B behind the person who is speaking, signals levels are affected by the frequency characteristics shown in FIGS. 6A to 6E in addition to attenuation corresponding to distance from the person who is speaking. It should be noted that at the locations C to E in front of the person who is speaking, signal levels are affected by attenuation of distance. Also, signals reach the locations A to E with propagation time delays corresponding to distances from the person who is speaking.

In the sound reinforcement system according to the present embodiment, an input signal from a microphone closest to the person who is speaking (in this example, a microphone MIC3) is selected and input to the speaker output adjusting section 25, and control is carried out such that signals reinforced by amounts indicated by "*" in FIG. 7 are output to the speakers SP1, SP2, SP5, and SP6 corresponding to the respective positions A to E so that the signal levels can be equal to targeted levels indicated by broken lines in FIG. 7 at a listening height at the locations A to E. On this occasion, delay times corresponding to distances from the person who is speaking are added to the sound-reinforced signals so that the sound-reinforced signals are output in the same timing as direct incoming waves from the person who is speaking, and the resultant signals are output. In the illustrated example, the speakers SP3 and SP4 are controlled so as not to output sound-reinforced signals since high-level direct waves are incoming from the person who is speaking.

As a result, speech made by a person who is speaking can be heard at the same tone at any location in the room.

When a plurality of persons are speaking at the same time and there are a plurality of sound source positions, sound of a plurality of channels can be reinforced at the same time as is the case with the above described first embodiment. When there are a plurality of sound sources, the output level and the delays are controlled for each of the speakers so that sound is reinforced with the sound pressure level being the same at any location in the room, with respect to each microphone corresponding to each position of the plurality of sound source positions, as in the case where sound of one channel is reinforced as described before. In this case, the input switching section 3 may select input signals from a plurality of (for example, two) microphones, and the speaker output adjusting section 25 capable of processing signals of a plurality of channels controls the output level and the delay for signals to be output to the respective speakers 5 with respect to each of the input signals, add together output signals of the plurality of channels, and output the resultant signal to each speaker.

As described above, according to the present invention, the microphones and the speakers have limited directivities (narrow directivity angles). Also, outputs from speakers in the vicinity of a selected microphone are adjusted to be small, and outputs from speakers away from the microphone are adjusted to be large. As a result, inputs from a plurality of microphones can be reinforced at the same time at low risk of howling.

Figure 8:
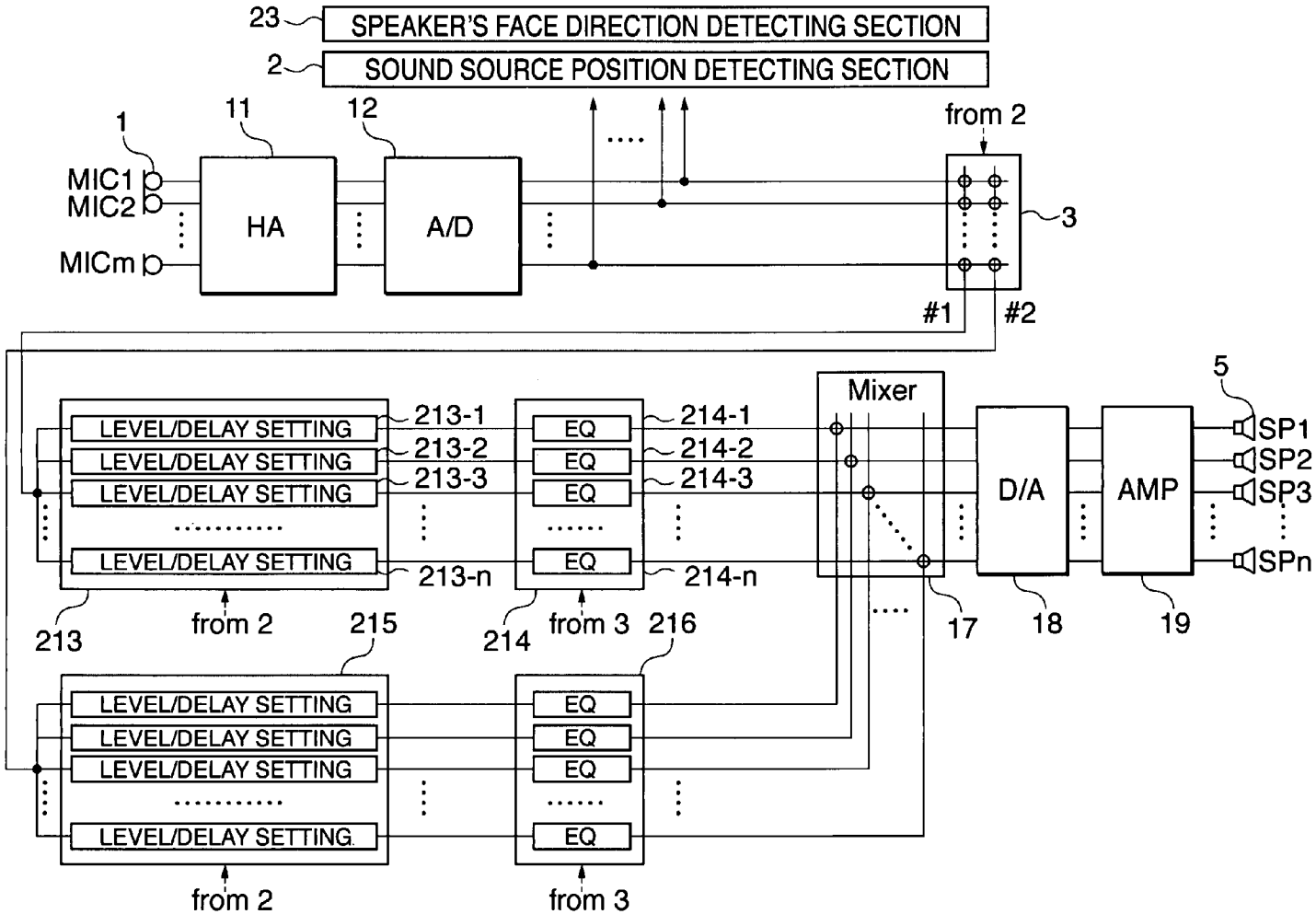
FIG. 8 is a diagram showing the configuration of the sound reinforcement system in FIG. 5 more concretely.

FIG. 8 is a block diagram showing the configuration of the sound reinforcement system according to the second embodiment of the present invention more concretely. In the sound reinforcement system in FIG. 8, input signals of up to two channels can be processed at the same time.

In FIG. 8, component elements corresponding to those appearing in FIG. 3A and FIG. 5 referred to above are denoted by the same reference numerals, and description thereof is omitted.

Input signals corresponding to sound picked up by a plurality of microphones 1 (MIC1 to MICm) arranged at dispersed locations on the ceiling as described above are amplified by the head amplifier group 11 and then converted into digital data by the A/D converter 12. The input signals from the respective microphones 1 are output from the A/D converter 12 and input to the sound source position detecting section 2 and the speaker's face direction detecting section 23 as well as the input switching section 3.

As described above, the sound source position detecting section 2 determines that a person who is speaking lies in an area in the vicinity of a microphone from which a signal with the highest level is input among input signals with levels equal to or higher than a predetermined level (the area where sound can be picked up by the microphone), detects the location of the microphone (MICi) as a sound source position. The sound source position detecting section 2 outputs information that designates the microphone detected as the sound source position to the input switching section 3, and outputs a control signal for controlling the output level and the delay for signals to be output from the respective speakers 5 in accordance with the sound source position being the microphone to output level/delay control sections 213 and 215, described later.

The speaker's face direction detecting section 23 detects the direction of the face of a person who is speaking from a pattern of frequency-specific signal levels of input signals from the respective microphones 1, and outputs parameters for correcting frequency characteristics of signals to be output from the respective speakers 5 according to the detected direction of the face of the person who is speaking to equalizer groups 214 and 216, described later.

The output level/delay control section 213 controls the output level and the delay time for each of the speakers 5, which are arranged at dispersed locations, with respect to an input signal supplied via the first output #1 of the input switching section 3. The output level/delay control section 213 is comprised of output level/delay control sections 213-1 to **213-*n*** associated with the respective speakers.

The equalizer group 214 corrects frequency characteristics of respective output signals from the output level/delay control section 213 in accordance with the direction of the face of a person who is speaking. The equalizer group 214 are comprised of equalizers 214-1 to **214-*n* associated with the respective speakers 5**.

Similarly, the output level/delay control section 215 is provided in association with the second output #2 of the input switching section 3, and the equalizer group 216 corrects frequency characteristics of respective output signals from the output level/delay control section 215 in accordance with the direction of the face of a person who is speaking.

An input signal output from the first output #1 of the input switching section 3 (a signal of sound picked up by the microphone MICi) is supplied to the output level/delay control section 213. The output level/delay control sections 213-1 to **213-*n* associated with the respective speakers 5 set the output levels and delay times for the input signal in accordance with the positional relationships between the microphone MICi and the respective speakers 5. A control signal for this setting is supplied from the sound source position detecting section 2 as described above. As a result, signals having time delays corresponding to delays in propagation from the microphone MICi and output levels that can compensate for the amount of attenuation by distance from the microphone MICi are output for the respective speakers 5. The output signals for the respective speakers 5 from the output level/delay control section 213 are input to the equalizers 214-1 to 214-*n* provided in association with the respective speakers 5. The equalizers 214-1 to 214-*n* correct frequency characteristics of the output signals in accordance with the direction of the face of the person who is speaking based upon the parameters supplied from the speaker's face direction detecting section 23** as described above.

As a result, output signals with the targeted levels as shown in FIG. 7, i.e., output signals with levels being the same at any location in the room are output.

When a second person starts speaking and the sound source position detecting section 2 detests a second sound source position, control is carried out such that information indicative of a microphone (referred to as a microphone MICj) as the second sound source position is supplied from the sound source detecting section 2 to the input switching section 3, and an input signal from the microphone (MICj) is connected to the second output #2 of the input switching section 3.

The input signal output via the second output #2 is supplied to the output level/delay control section 215 for the second channel, which is identical in configuration with the output level/delay control section 213 for the first channel. The output level/delay control section 215 controls the output level and the delay for each of the speakers with respect to the input signal in the same manner as described above. Thereafter, the equalizer group 216 identical in configuration with the equalizer group 214 for the first channel add such frequency characteristics as to correct frequency characteristics in accordance with the direction of the face of the person who is speaking, and output the resultant signals to the mixer 17.

Signals of which output levels and delay times have been controlled and frequency characteristics have been corrected for the respective speakers 5 with respect to the input signal from the microphone MICi by the equalizer group 214, and signals of which output levels and delay times have been controlled and frequency characteristics have been corrected for the respective speakers with respect to the input signal from the microphone MICj by the equalizer group 216 are added together by the mixer 17, converted into respective analog signals by the D/A converter group 18, power-amplified by the amplifier group 19, and output from the respective corresponding speakers 5 (SP1 to SPn).

As a result, sound made by a person who is speaking can be heard at the same volume level and with high quality at any location in the room.

Figure 9:
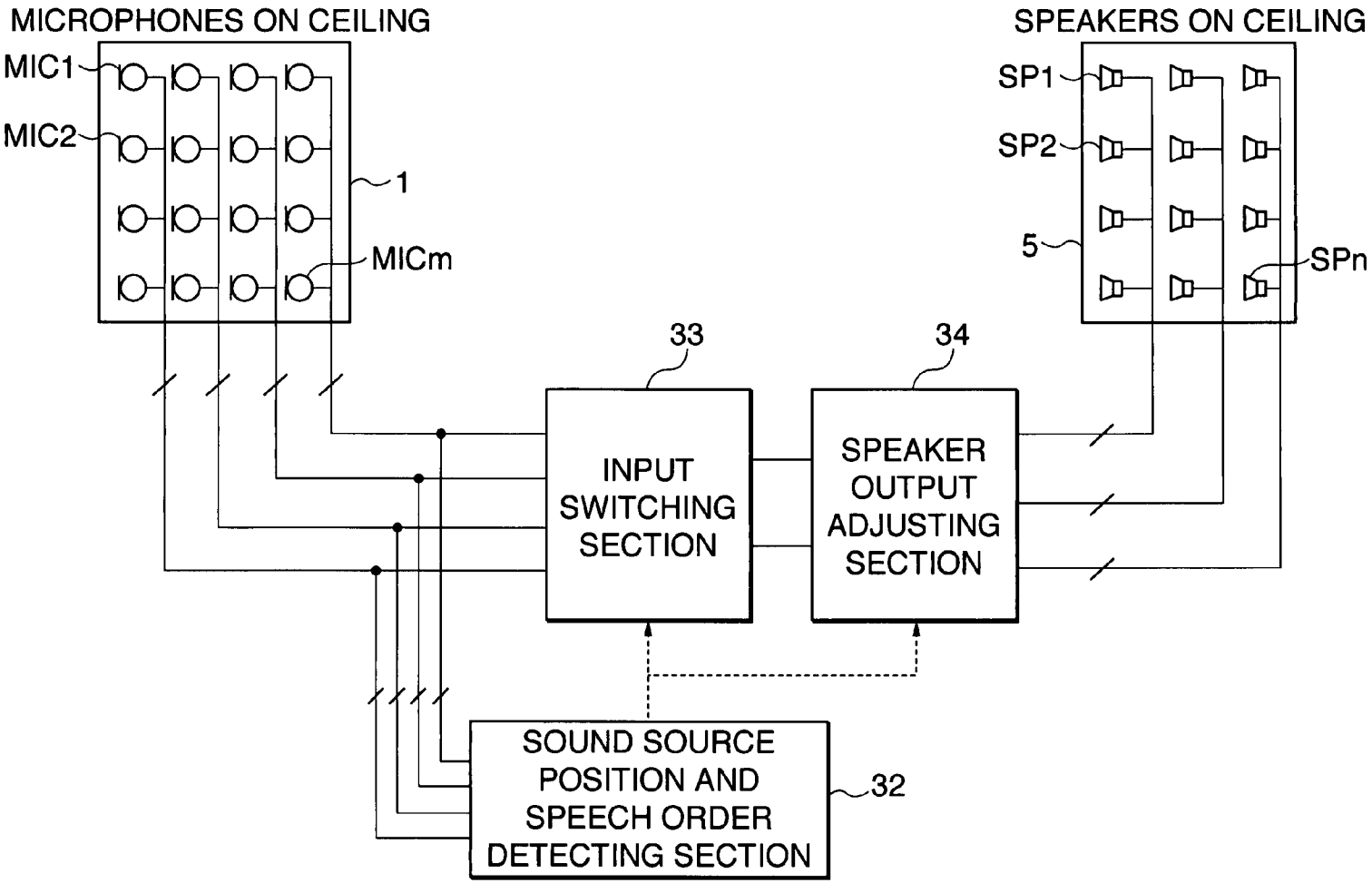
FIG. 9 is a block diagram schematically showing the configuration of a sound reinforcement system according to a third embodiment of the present invention.

FIG. 9 is a block diagram showing the overall configuration of a sound reinforcement system according to a third embodiment of the present invention.

The same component elements of the sound reinforcement system according to the third embodiment as those of the sound reinforcement system according to the first embodiment described above are denoted by the same reference numerals, and description thereof is omitted.

In FIG. 9, reference numeral 1 denotes a plurality of (m) microphones arranged at dispersed locations on the ceiling of a conference room, a hall, or the like equipped with the sound reinforcement system according to the present embodiment, and reference numeral 5 denotes a plurality of (n) speakers arranged at dispersed locations on the ceiling similarly to the microphones 1.

In FIG. 9, reference numeral 32 denotes a sound source position and speech order detecting section that monitors the levels of input signals from respective ones (MIC1 to MICm) of the plurality of microphones 1 to detect the positions of persons who speak and the order in which the persons speak, and outputs control signals to an input switching section 33 and a speaker output adjusting section 34. The input switching section 33 selects an input signal from a microphone corresponding to the position of a person who is speaking based on a control signal (sound source position detection signal) from the sound source position and speech order detecting section 32, and outputs the selected input signal to the speaker output adjusting section 34. The speaker output adjusting section 34 carries out level control and delay control for respective ones of the speakers 5 with respect to the input signal from the input switching section 33 based on a control signal supplied from the sound source position and speech order detecting-section 32, and outputs the resultant signals to the respective speakers 5 (SP1 to SPn).

The input switching section 33 is capable of selecting input signals from microphones of a plurality of (for example, two) channels, and the speaker output adjusting section 34 is capable of controlling the output level and the delay with respect to each of the input signals from a plurality of (for example, two) microphones selected by the input switching section 33, adding together output signals of the plurality of channels, and outputting the resultant signal to each speaker.

The sound source position and speech order detecting section 32 constantly monitors input signals from the plurality of microphones 1 (MIC1 to MICm). When there are any input signals equal to or higher than a predetermined level, the sound source position and speech order detecting section 32 determines that the location of a microphone MICi with the highest input signal level among the input signals is a sound source position (speaker's position). If no input signal with a level equal to or higher than the predetermined level is detected, the sound source position and speech order detecting section 32 determines that no person is speaking. In the case where there is any input signal(s) with a level equal to or higher than the predetermined level and the presence of a first person who is speaking is detected, when an input signal from a microphone MICj at another location is equal to or higher than the predetermined level and exhibits the maximum level among the input signals from the plurality of microphones except the microphone MICi, the location of the microphone MICj is detected as the position of a new person who is speaking (a second person who is speaking). In this manner, the sound source position and speech order detecting section 32 can detect the positions of a plurality of persons who speak (sound source positions) and the order in which they speak.

As described above, information relating to the detected sound source positions (sound source position detection signals) is supplied to the input switching section 33, which in turn selects input signals based upon the sound source position detecting signals and outputs the selected input signals to the speaker output adjusting section 34.

Also, the sound source position and speech order detecting section 32 outputs a control signal for setting the output levels and delay times (delays) of signals to be output from the respective speakers 5 (SP1 to SPn) to the speaker output adjusting section 34 so that the sound pressure level at a listening height can be the same at any location in the room when the input signals from the microphones MICi and MICj detected as the sound source positions are reinforced and output from the speakers 5 (SP1 to SPn).

Here, the output levels of signals from the respective speakers 5 are determined so that the sum of a direct sound from a person who is speaking and a reinforced sound from the corresponding speaker can be the same at any location in the room. That is, the output level of speakers away from a sound source position is controlled so as to compensate for the amount of distance attenuation of a direct sound. The output level of a signal from each speaker may be computed based upon the distance between a sound source position (the position of a microphone located in the vicinity of a person who is speaking) and the speaker, or may be determined by referring to a table prepared in advance on which output levels associated with the respective speakers are recorded with respect to each sound source position.

When a second person who has started speaking is detected during speaking by a first person, the output level of a speaker located in the vicinity of the new sound source position (the position of the second person) is controlled to be decreased. For example, the speaker may be turned off. This prevents the formation of a closed loop caused by usage of microphones of a plurality of channels as described later.

The delays are intended to give delay times corresponding to times needed for direct sound from a sound source position to reach the respective speakers to sound-reinforced signals to be output from the respective speakers 5. The delays may be calculated based upon the distances between a sound source position (the position of a microphone) and the respective speakers 5, or may be determined by referring to a table prepared in advance on which delay times for the respective speakers are recorded with respect to each sound source position.

Figure 10:
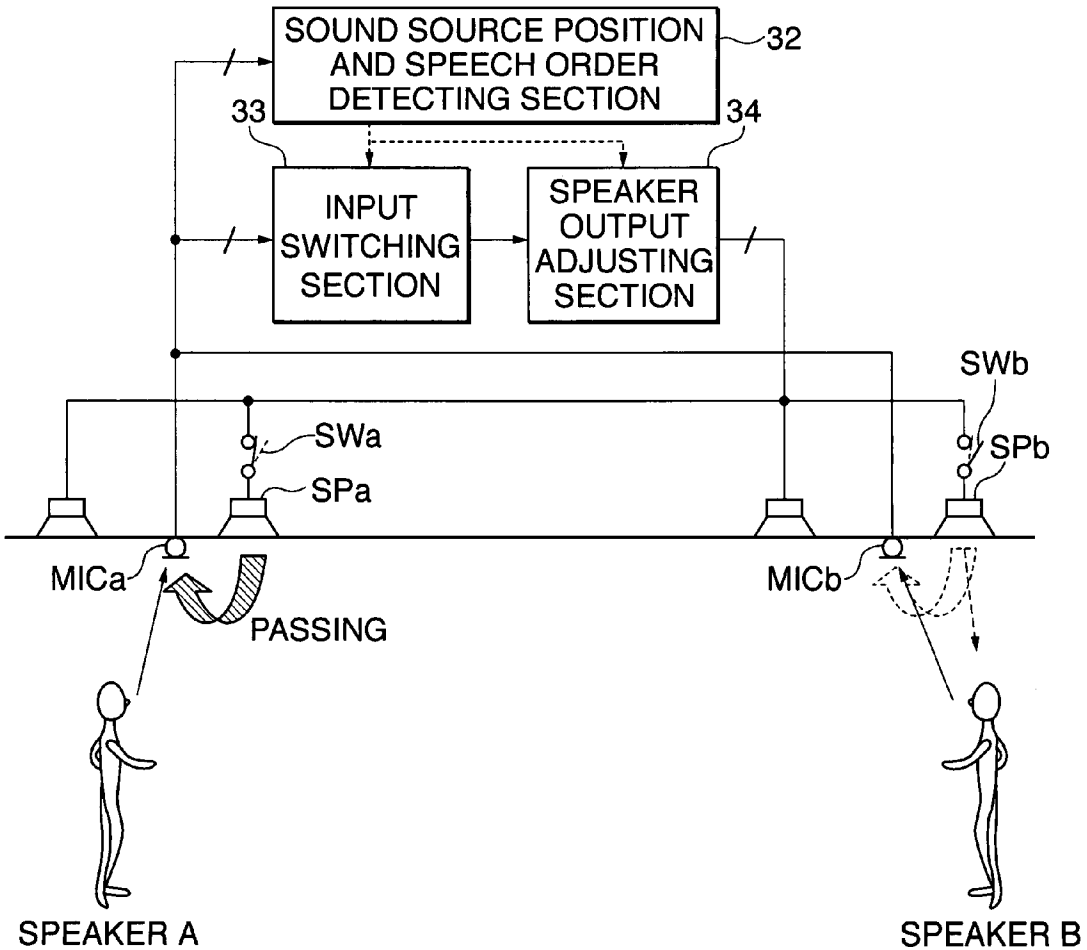
FIG. 10 is a diagram useful in explaining the operation of the sound reinforcement system in FIG. 9.

Referring to FIG. 10, a description will now be given of the operation of the sound reinforcement system configured as described above.

Assume that a person A starts speaking.

The sound source position and speech order detecting section 32 detects that the level of input signal from a microphone MICa in the vicinity of the person A is the highest level, and then, detects the microphone MICa as a sound source position. The input switching section 33 outputs the input signal from the microphone MICa to the speaker output adjusting section 34 based on a sound source position detection signal from the sound source position and speech order detecting section 32.

On this occasion, since no other persons are speaking, the sound source position and speech order detecting section 32 outputs a control signal to the speaker output adjusting section 34 such that the sound reinforcement gain (output level) of speakers away from the person A is large, and the sound reinforcement gain of speakers in the vicinity of the person A is small or these speakers are turned off. In FIG. 10, switches SWa and SWb are illustrated so that the state in which the sound reinforcement gain of speakers is decreased can be easily understandable. At this time, as indicated by broken lines in FIG. 10, the switch SWa connected to a speaker SPa in the vicinity of the person A is off, and the switch SWb away from the person A is on.

Assume that a person B starts speaking next.

When the sound source position and speech order detecting section 32 detects that the level of an input signal from a microphone MICb in the vicinity of the person B becomes higher than the levels of input signals from the other microphones, following the level of the signal from the microphone MICa, and then, detects the microphone MICb as a new sound source position. The sound source position and speech order detecting section 32 then supplies a sound source position detection signal that identifies the microphone MICb as the new sound source position subsequently to the person A's speech in speech order to the input switching section 33. Responsive to this, the input switching section 33 outputs the input signal from the microphone MICb as well as the already selected input signal from the microphone MICa to the speaker output adjusting section 34. In response to a control signal from the sound source position and speech order detecting section 32, the speaker output adjusting section 34 carries out level control in accordance with the distance between the person B (MICb) and the speakers 5 with respect to the input signal from the microphone MICb, and outputs reinforced sound from the speakers. As a result, the sound signal from the first person A having the sound-reinforcement gain based on the distance from the person A and the sound signal from the second person B having the sound-reinforcement gain based on the distance from the person B are added together, and the resultant sound signal is output from each speaker.

The sound-reinforcement gain of the speaker SPb located in the vicinity of the person B is controlled as described below.

When the person B starts speaking while the person A is speaking, it is assumed that the person B guesses what the person A is going to say, or determines that it is unnecessary to listen to what the person A is saying any longer, and hence the sound made by the person A does not have to be reinforced for the person B.

Thus, the sound source position and speech order detecting section 32 controls the speaker output adjusting section 34 such that the sound-reinforcement gain of the speaker SPb in the vicinity of the microphone MICb which picks up sound made by the person B who speaks subsequently to the person A's speech is decreased or the speaker SPb is turned off. That is, in the example shown in FIG. 10, the switch SWb connected to the speaker SPb in the vicinity of the person B (MICb) is turned off.

It is therefore possible to prevent sound from passing from the speaker SPb to the microphone MICb, and therefore prevent the formation of a feedback loop of the person A→the microphone MICa→the speaker SPb→the microphone MICb→the speaker SPa→the microphone MICa. As a result, it is possible to prevent howling caused by usage of microphones of two channels.

It should be noted that the sound-reinforcement gain of the speaker SPa in the vicinity of the person A, which has been controlled to be a low value, is controlled to be normal so that the person A or a person in the vicinity of the person A can listen to sound made by the person B. That is, in the example shown in FIG. 10, the turned-off switch SWa connected to the speaker SPa in the vicinity of the person A is turned on.

Thereafter, each time a new person who is speaking is detected, control is carried out such that the output level of a speaker located in the vicinity of a microphone which picks up sound made by the detected person is decreased or the microphone is turned off, and sound-reinforced signals are output at a normal output level from speakers of which output levels have been decreased or which have been kept off.

As described above, by controlling the sound-reinforcement gain of speakers according to rules based on patterns of interaction, a feedback loop caused by usage of a plurality of microphones and a plurality of speakers at the same time can be cut. As a result, it is possible to prevent howling in the sound reinforcement system using microphones of a plurality of channels without carrying out complicated control.

Although in the embodiment described with reference to FIG. 9, the sound reinforcement system is configured such that the plurality of microphones and the plurality of speakers are arranged at dispersed locations on the ceiling, the present invention is not limited to this, but the present invention can be applied to any other sound reinforcement systems insofar as inputs from a plurality of microphones can be output from a plurality of speakers in the same acoustic space, similarly to the present embodiment.

Figure 11:
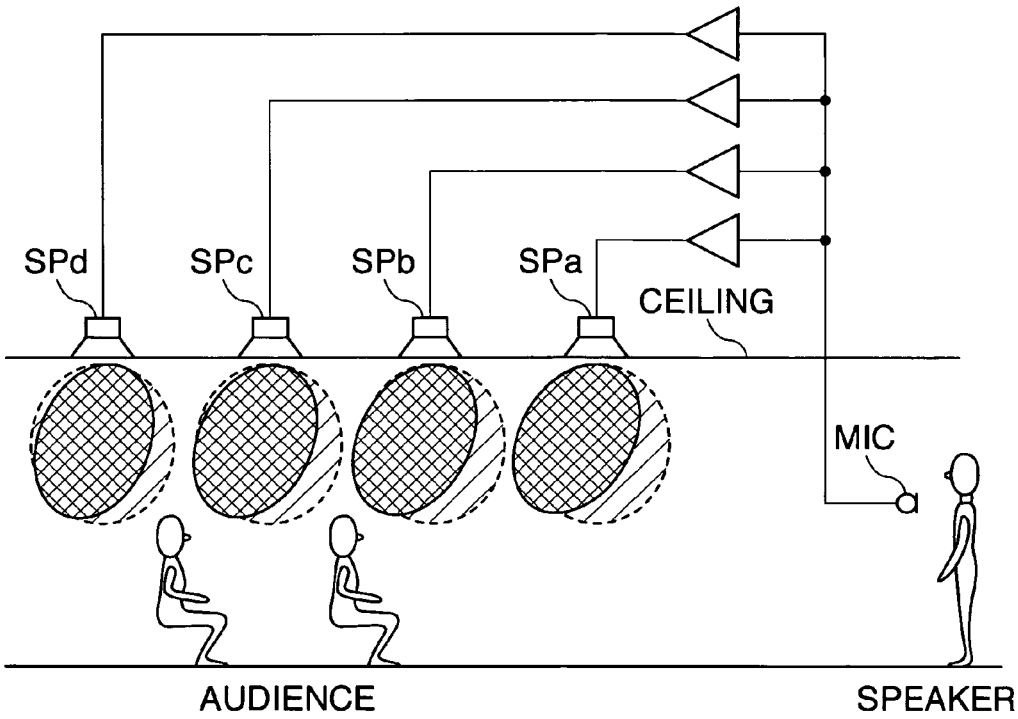
FIG. 11 is a diagram schematically showing the most basic configuration of a sound reinforcement system according to a fourth embodiment of the present invention.

FIG. 11 is a diagram schematically showing the most basic configuration of a sound reinforcement system according to a fourth embodiment of the present invention.

In FIG. 11, "SPa" to "SPd" designate speakers arranged at dispersed locations on the ceiling of a room, and "MIC" denotes a microphone. The sound made by a person who is speaking is picked up by the microphone MIC and reinforced at respective suitable output levels from the speakers SPa to SPd. On this occasion, the output levels of signals output from the respective speakers Spa to SPd are controlled to be increased as they become away from the person who is speaking so that reinforced sound can be uniform throughout the room. Although not illustrated, the delay of the signal output form each speaker is adjusted so that the signal output from each speaker has a delay time corresponding to the time required for the propagation of sound from the person who speaks to the speaker.

In the present embodiment, the speakers SPa to SPd are adjusted such that their directivity axes are oriented in directions opposite to the person who is speaking. Specifically, the speakers Spa to SPd have vertical directivities as indicated by broken lines in FIG. 11, but as shown in FIG. 11, the directivity axes of the respective speakers SPa to SPd are tilted in directions opposite to the person who is speaking. The angles at which the directivity axes of the respective speakers are tilted may be the same with respect to all the speakers, or may be increased or decreased as the speakers become closer to the person who is speaking, insofar as the directivity axes are oriented in the same direction. In an alternative example, the speakers may be tilted at angles different from each other.

An example of the method to tilt the directivity axes of the respective speakers Spa to SPd at desired angles is to tilt the speakers in mounting them on the ceiling. Another example is to attach a mechanical fin to each speaker so as to add desired directivity characteristics to sound emitted from the speaker. In an alternative example, each of the speakers may be implemented by a speaker array comprised of a plurality of speaker units, and the directivity of each speaker array may be controlled by adjusting the phases and levels of signals to be supplied to the respective speaker units.

As stated above, the directivity axes of the respective speakers arranged at dispersed locations on the ceiling are set in directions opposite to the person who is speaking, whereby they listen to reinforced sound from the speakers located on the ceiling in the direction of the person who is speaking. Therefore, the audience never feels discomfort since the sense of hearing and the sense of sight are consistent with each other, and it is possible to reinforce sound made by a person who is speaking, naturally.

In the above described embodiments, fixed microphones are used. A description will now be given of a fifth embodiment of the present invention which is applied to the case where a person who is speaking is allowed to move. For example, a person who is speaking moves with a microphone, or sound made by a person who is speaking is picked up using a microphone array.

In the fifth embodiment, a sound source position detecting section that detects the position of a person who is speaking (sound source position) is required. In the case where a person who is speaking carries a microphone, the position of the microphone can be detected using an infrared sensor or an ultrasonic sensor. In the case where a microphone array is used, the position of a person who is speaking can be detected based upon outputs from a plurality of microphones even without using an infrared sensor or ultrasonic sensor.

In the present embodiment, the sound source position detecting section detects a sound source position, and the directivity axes of the plurality of speakers arranged at dispersed locations are controlled to be oriented in directions opposite to the sound source position.

Figure 12:
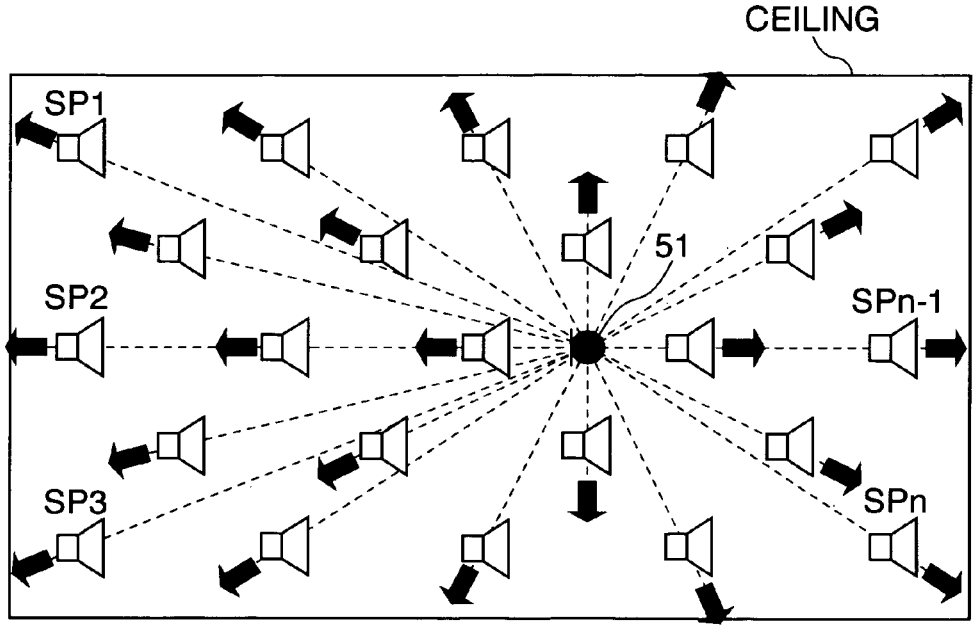
FIG. 12 is a diagram useful in explaining the directivities of speakers in a sound reinforcement system according to a firth embodiment of the present invention.

FIG. 12 is a view useful in explaining the directivities of the plurality of speakers in the sound reinforcement system according to the present embodiment, and a plan view showing a conference room equipped with the sound reinforcement system according to the present embodiment.

In FIG. 12, reference numeral 51 denotes a microphone. If the microphone 51 is placed at the illustrated location, the speakers (SP1 to SPn) are controlled such that their directivity axes are oriented in directions opposite to a sound source position (the position of the microphone 51) as indicated by arrows in FIG. 12. That is, the directivity axes of the plurality of speakers are controlled to be oriented in radial directions about the sound source position as viewed from above. When the person who is speaking moves with the microphone 51, the sound source position detecting section detects a new sound source position, and the plurality of speakers are controlled such that their directivity axes are oriented in directions opposite to the new sound source position.

As described above, according to the present embodiment, since the directivities of the speakers are changed in response to changes in sound source positions, the plurality of speakers are implemented by those of which directivities can be controlled to be changed. An example of such speakers is a speaker array. Alternatively, speakers of which mechanical fins for controlling directivities are changeable in direction under electric signals or speakers of which mounting angles are changeable may be used.

Figure 13A:
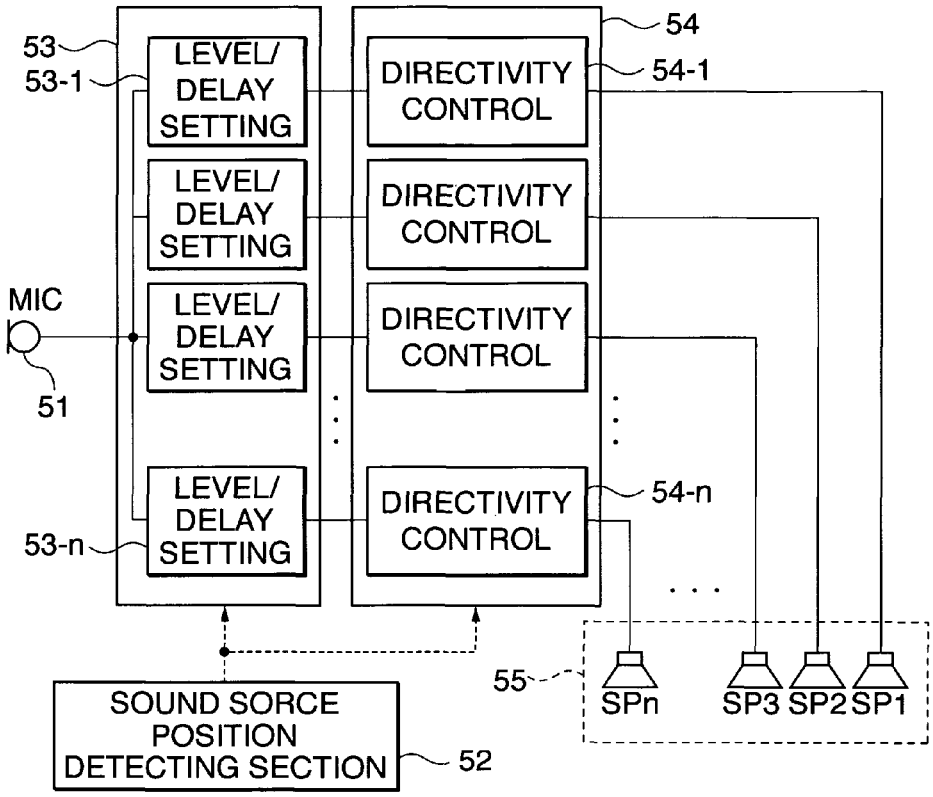
Figure 13B:
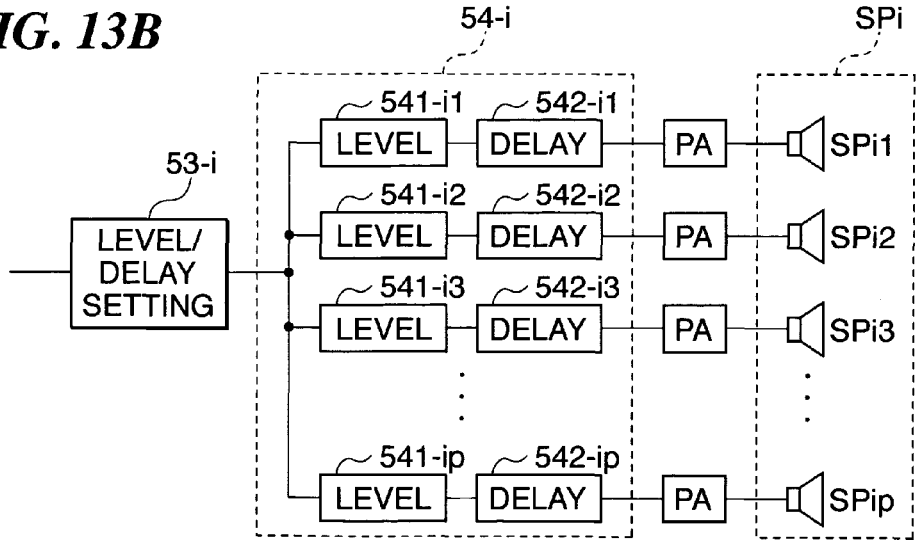

FIGS. 13A and 13B are block diagrams showing the configuration of the sound reinforcement system in FIG. 12, in which FIG. 13A shows the overall configuration of the sound reinforcement system, and FIG. 13B shows the configurations of output level/directivity control sections of the sound reinforcement system.

In FIG. 13A, reference numeral 51 denotes the microphone 51 that can be carried by a person who is speaking; 52, a sound source position detecting section that detects a sound source position (the position of a person who is speaking) using an infrared sensor, an ultrasonic sensor, or the like; 53, an output level/delay setting section that sets the output levels and delay times of signals to be output to the respective speakers arranged at dispersed locations on the ceiling; 54, a directivity control section that controls the directivities of the speakers; and 55, speakers SP1 to SPn arranged at dispersed locations on the ceiling. In the present embodiment, the plurality of speakers SP1 to SPn are each implemented by a speaker array comprised of a plurality of (p) speaker units (see FIG. 13B).

As shown in FIG. 13A, the output level/delay setting section 53 is provided in association with the plurality of speakers SP1 to SPn, and is comprised of output level/delay setting circuits 53-1 to **53-*n* that set the output levels and delay times of signals to be output from the respective speakers SP1** to SPn.

The directivity control section 54 is comprised of directivity control circuits 54-1 to **54-*n* that control the directivities of the respective speakers SP1** to SPn.

FIG. 13B is a block diagram showing the configuration of each directivity control circuit **54-*i* (i=1 to n) provided in association with each of the speakers SP1** to SPn.

As shown in FIG. 13B, each directivity control circuit **54-*i* is comprised of level control circuits 541-*i*1 to 541-*ip* and delay circuits 542-*i*1 to 542-*ip* provided in association with p speaker units included in the corresponding speaker array SPi. The level control circuits 541-*i*1 to 541-*ip* assign weights to signals to be output to the respective speaker units, and the delay circuits 542-*i*1 to 542-*ip* control the phases of the signals. In the directivity control circuit 54-*i*, the output levels and delay times of signals to be output to the respective speaker units, which are intended for controlling the directivity axis of the corresponding speaker array SPi to be oriented in a direction opposite to a sound source position detected by the sound source position detecting section 52, are set with respect to a signal from a corresponding output level/delay setting circuit 53**-*i*. It should be noted that a control signal for setting the output levels and the delay times is supplied form the sound source position detecting section 52.

The signals for the respective speaker units output from the delay circuits 542-*i*1 to 542-*ip* are amplified by power amplifiers and then output to the respective speaker units SPi1 to SPip constituting the speaker array SPi.

In the sound reinforcement system configured as described above, the sound source position detecting section 52 detects a sound source position (the position of the person who is speaking or the position of the microphone 51) using an infrared sensor, an ultrasonic sensor, or the like. The sound source position detecting section 52 then calculates the output levels and delay times of signals to be output to the respective speakers SP1 to SPn based on the distances between the detected sound source position and the respective speakers SP1 to SPn, and supplies a control signal for setting the calculated output levels and delay times to the output level/delay setting circuits 53-1 to 53-*n* of the output level/delay setting section 53. Specifically, the sound source position detecting section 52 sets the output levels of signals to be output from the respective speakers SP1 to SPn to such levels as to compensate for the amounts of attenuation by distance from the sound source position of speech (direct wave) made by the person who is speaking to the respective speakers SP1 to SPn, and sets the delay times of signals to be output from the respective speakers SP1 to SPn to delay times corresponding to delays by propagation of speech (direct wave) made by the person who is speaking to the respective speakers SP1 to SPn.

The sound source position detecting section 52 also determines the directivities of the respective speakers SP1 to SPn based on the positional relationship between the detected sound source position and the respective speakers SP1 to SPn, calculates parameters to be set for the level control circuits 541-*i*1 to 541-*ip* and the delay circuits 542-*i*1 to 542-*ip* of each directivity control circuit 54-*i* in the directivity control section 54, and supplies the calculated parameters to the directivity control circuits 54-1 to 54-*n*.

With respect to an input signal from the microphone 51, the output level/delay setting section 53 sets the output levels and delay times depending on the distances between the detected sound source position and the respective speakers SP1 to SPn, and the directivity control section 54 provides control such that the directivity axes of the respective speakers SP1 to SPn are oriented in directions opposite to the detected sound source position as shown in FIG. 12. The resultant sound-reinforced signals are output from the respective speaker arrays SP1 to SPn.

As a result, as shown in FIG. 12, the sound-reinforced signals are output radially about the sound source position, and hence the audience can listen to the reinforced sound from the direction of the sound source position and does not feel discomfort since the sense of hearing and the sense of sight are consistent with each other.

Although in the above described embodiment, the microphone 51 is the type that can be carried by the person who is speaking, the microphone 51 may be implemented by a microphone array. If a microphone array is used, sound made by the person who is speaking may be picked up by the microphone array and reinforced from a plurality of speakers as described above, and information indicative of the position of the person who is speaking detected by the microphone array or detected using an infrared sensor, an ultrasonic sensor, or the like may be output from the sound source position detecting section 52 so as to control the directivities of the plurality of speakers.

Further, although in the above described embodiment, the speakers SP1 to SPn are implemented by respective speaker arrays, speakers equipped with mechanical fins of which directions can be controlled, speakers of which mounting angles are changeable, and so forth may be used.

A description will now be given of a sound reinforcement system according to a sixth embodiment of the present invention, which can reinforce sound of a plurality of channels.

In the sixth embodiment, a plurality of microphones and a plurality of speakers are arranged at dispersed locations on the ceiling of a conference room or the like equipped with the sound reinforcement system, and sound made by a person who is speaking is picked up by the microphones arranged at dispersed locations on the ceiling and reinforced from the plurality of speakers. The position of a person who is speaking (sound source position) is detected based on the levels of output signals from the plurality of microphones, and the directivity axes of the plurality of speakers are controlled to be oriented in directions opposite to the person who is speaking. When a plurality of persons are speaking at the same time, the directivity axes are controlled to be oriented in directions opposite to the sound source positions with respect to reinforced signals of sound made by the respective persons, and the resultant sound-reinforced signals are output from the plurality of speakers.

Figure 14:
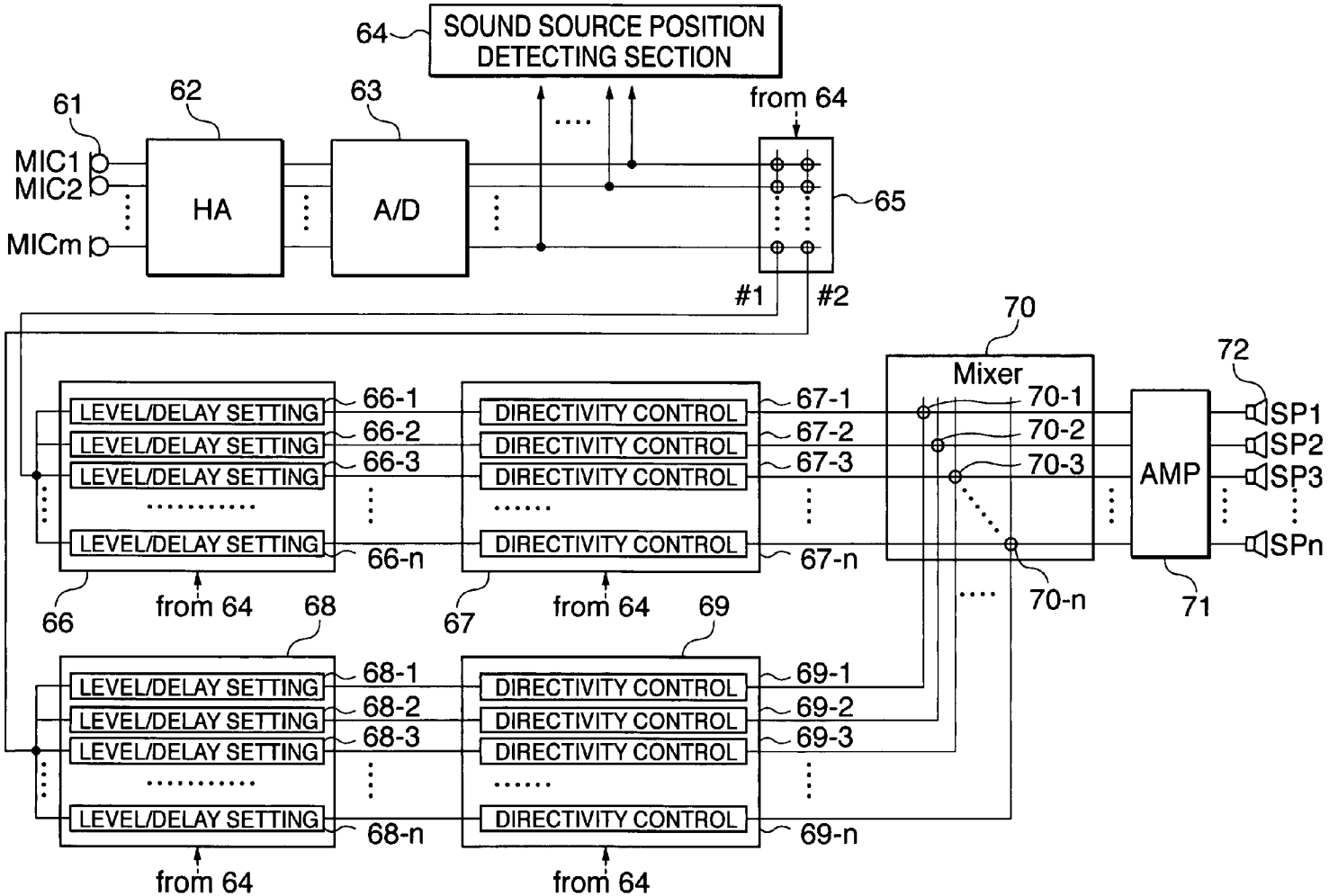
FIG. 14 is a block diagram schematically showing the configuration of a sound reinforcement system according to a sixth embodiment of the present invention.

FIG. 14 is a block diagram showing the configuration of the sound reinforcement system according to the sixth embodiment. In the present embodiment, a speaker array comprised of a plurality of (p) speaker units is used as the plurality of speakers arranged at dispersed locations on the ceiling. In the sound reinforcement system according to the present embodiment, input signals of up to two channels can be processed.

In FIG. 14, reference numeral 61 denotes a plurality of (m) microphones (MIC1 to MICm) arranged at dispersed locations on the ceiling, and reference numeral 72 denotes a plurality of (n) speakers (speaker array) arranged at dispersed locations on the ceiling, Reference numeral 62 denotes a head amplifier group comprised of a plurality of (m) head amplifiers provided for the respective microphones MIC1 to MICm, and reference numeral 63 denotes an A/D converter section comprised of a plurality of (m) A/D converters that convert outputs from the plurality of head amplifiers into respective digital signals.

Input signals of sound picked up by the plurality of microphones (MIC1 to MICm) arranged at dispersed locations on the ceiling are amplified by the head amplifier group 62 and then converted into digital data by the A/D converter section 63. The input signals from the respective microphones MIC1 to MICm are output from the A/D converter section 63 and input to a sound source position detecting section 64 as well as an input switching section 65.

The sound source position detecting section 64 constantly monitors input signals from the plurality of microphones (MIC1 to MICm), and determines that the location of a microphone MICi from which a signal with the highest level is input is a sound source position (first speaker's position) when there are input signals with levels equal to or higher than a predetermined level. In the case where there is any input signal(s) with a level equal to or higher than the predetermined level and the presence of a first person who is speaking has been detected, when an input signal from a microphone MICj at another location is equal to or higher than the predetermined level and exhibits the maximum level among the input signals from the plurality of microphones except the microphone MICi, the location of the microphone MICj is detected as the position of a new person who is speaking (a second person who is speaking). If the speaker in the vicinity of the microphone MICi stops speaking and there is no input signal with a level equal to or higher than the predetermined level from the microphone MICi, it is determined that the sound source at the microphone MICi has disappeared. Further, if a signal with a level equal to or higher than a predetermined level is input from another microphone MICk, it is determined that the sound source position has moved to the microphone MICk or a new sound source appears at the microphone MICk.

The input switching section 65 has first and second outputs of two channels designated by "#1" and "#2" in FIG. 14, and selectively connects an input signal from a microphone determined as being a sound source position by the sound source position detecting section 64 to either of the two outputs. For example, the input switching section 65 connects an input signal from a microphone corresponding to a sound source position detected first to the first output #1, and connects an input signal from a microphone corresponding to a sound source position detected next to the second output #2. In this manner, inputs from two sound source positions can be processed.

Reference numeral 66 denotes an output level/delay setting section that controls the output level and the delay time for the plurality of speaker arrays SP1 to SPn arranged at dispersed locations with respect to an input signal supplied via the first output #1 of the input switching section 65. The output level/delay setting section 66 is comprised of output level/delay setting circuits 66-1 to **66-*n* for the respective speaker arrays SP1 to SPn. The output level/delay setting section 66 controls the output level and the delay time in accordance with distances between a sound source position selected for the first output #1 and the respective speaker arrays SP1 to SPn based upon a control signal from the sound source position detecting section 64**.

Reference numeral 67 denotes a directivity control section for controlling the directivities of the respective speakers SP1 to SPn with respect to outputs from the output level/delay setting section 66. The directivity control section 67 is comprised of directivity control circuits 67-1 to **67-*n* for the respective speaker arrays SP1** to SPn.

Similarly, reference numerals 68 and 69 denote an output level/delay setting section and a directivity control section, respectively, associated with the second-channel output #2. As shown in FIG. 14, the output level/delay setting section 68 is comprised of output level/delay setting circuits 68-1 to **68-*n* for the respective speaker arrays SP1 to SPn, and the directivity control section 69 is comprised of directivity control circuits 69-1 to 69-*n* for the respective speaker arrays SP1 to SPn for controlling the directivities of the respective speaker arrays SP1** to SPn.

Reference numeral 70 denotes a mixer that adds output signals for the respective speaker arrays SP1 to SPn, which are output from the directivity control sections 67 and 69, and is comprised of adders 70-1, 70-2, . . . , **70-*n* for the respective speaker arrays SP1 to SPn. Reference numeral 71 denotes an amplifier group that amplifies output signals from the respective adders 70-1 to 70-*n* of the mixer 70 to the respective speaker arrays SP1** to SPn.

Figure 15:
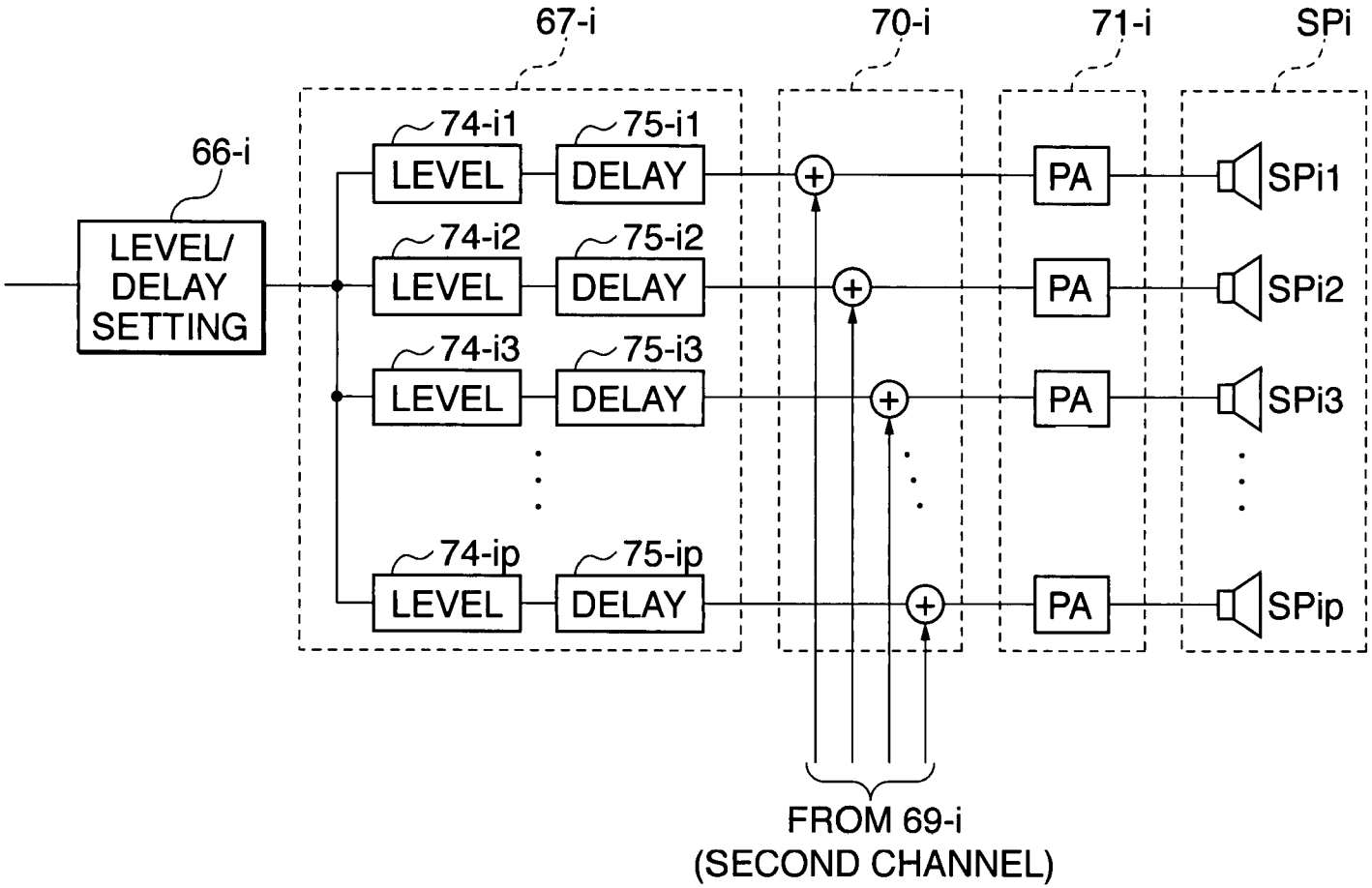
FIG. 15 is a block diagram showing a directivity control section of the sound reinforcement system in FIG. 14.

FIG. 15 is a diagram showing the configurations of the directivity control circuit **67-*i* of the directivity control section 67, which is provided for the speaker array SPi, and the adder 70-*i* (i=1 to n) of the mixer 70, which is provided for the speaker array SPi. It should be noted that the directivity control circuit 69-*i* is identical in configuration with the directivity control circuit 67-*i***.

As is the case with the above-described directivity control circuit **54-*i* appearing in FIG. 13B, the directivity control circuit 67-*i* is comprised of level control circuits 74-*i*1 to 74-*ip* for assigning weights to signals to be output to the respective speaker units SPi1 to SPip of the speaker array SPi, and delay circuits 75-*i*1 to 75-*ip* for controlling the delays of the signals Parameters for the level control circuits 74-*i*1 to 74-*ip* and the delay circuits 75-*i*1 to 75-*ip* are set such that the directivity axis of the speaker array SPi is oriented in a direction away from the position of the microphone MICi selected for the first output #1**.

The directivity control circuit **69-*i* for an input signal from the second output #2 assign directivities to an input signal from the microphone MICj selected for the second output #2** so that the directivity axis of the speaker array SPi is oriented in a direction opposite to the microphone MICj.

As shown in FIG. 15, the adder **70-*i* is comprised of p adders associated with the respective speaker units SPi1** to SPip of the speaker array SPi.

Outputs from the respective delay circuits **75-*i*1 to 75-*ip* of the directivity control circuit 67-*i* are supplied to the respective adders of the adder 70-*i*, which are associated with the respective speaker units SPi1 to SPip, and added to outputs for the respective speaker units SPi1 to SPip from the delay circuits of the directivity control circuit 69-*i* for the second output #2**.

The signals for the respective speaker units SPi1 to SPip of the speaker array Spi output from the respective adders of the adder **70-*i* are supplied to the respective speaker units SPi1 to SPip via respective power amplifiers (PA) provided in association with the respective speaker units SPi1** to SPip.

In this manner, directivities based on the positions of microphones are assigned to an input signal from the first-channel output #1 and an input signal from the second channel-output #2, and the resultant signals are output from the plurality of speakers.

Figure 16:
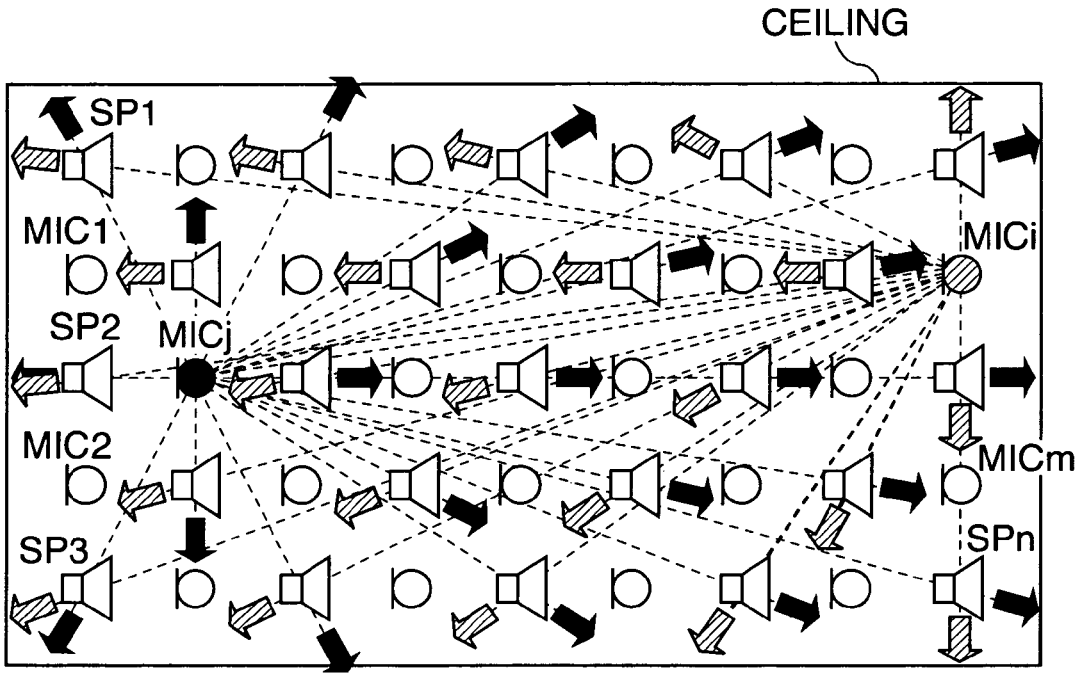
FIG. 16 is a diagram useful in explaining the directivities of speakers in the sound reinforcement system in FIG. 14.

FIG. 16 is a diagram useful in explaining the directions of directivity axes of output signals from the plurality of speakers SP1 to SPn according to the present embodiment.

As shown in FIG. 16, it is assumed that the microphone MICi and the microphone MICj are detected as sound source positions. In this case, an output signal from the first microphone MICi is output with such directivity as to be oriented in directions indicated by arrows with the same pattern as the microphone MICi in FIG. 16, i.e., directions opposite to the microphone MICi as viewed from the speakers SP1 to SPn. An output signal from the second microphone MICj is output with such directivity as to be oriented in directions opposite to the microphone MICj as viewed from the speakers SP1 to SPn as indicated by black arrows in FIG. 16.

As a result, the audience can listen to sound made by a person who is speaking in the vicinity of the first microphone MICi from the direction of the first microphone MICi and listen to sound made by a person who is speaking in the vicinity of the second microphone MICj from the direction of the second microphone MICj. Thus, the audience can listen to reinforced sound from directions consistent with their sense of sight.

Although in the above described fourth to sixth embodiments, a plurality of speakers are arranged at dispersed locations on a ceiling, the present invention is not limited to this, but the present invention can be applied to a room insofar as a plurality of speakers are provided is the room. That is, in the case where reinforced sound is output from a plurality of speakers, reinforced sound may be output form the speakers with directivity axes thereof being controlled to be oriented in directions opposite to a person who is speaking.

Although in the above described embodiments, a plurality of microphones and a plurality of speakers are arranged on the ceiling, in the present invention, they should not necessarily be arranged on the ceiling, but may be arranged at other locations. Also, examples of the method to arrange the plurality of microphones and the plurality of speakers at dispersed locations on the ceiling include a method in which the plurality of microphones and the plurality of speakers are arranged on the surface of the ceiling, and a method in which the plurality of microphones and the plurality of speakers are suspended from the ceiling via supporting parts.

What is claimed is:

1. A sound reinforcement system comprising:

a plurality of microphones disposed in a room;

a plurality of speakers disposed in the room;

a speaker output adjusting device that outputs sound picked up by said plurality of microphones to said plurality of speakers at predetermined levels;

a sound source position detecting device that selects a microphone corresponding to a sound source position based on input signals from said plurality of microphones, wherein each of said plurality of microphones has a limited directivity, each of said plurality of speakers has a limited directivity, and said speaker output adjusting device adjusts gains and delay times for an input signal input from a microphone corresponding to the sound source position selected by said sound source position detecting device depending on distances between said microphone and respective ones of said plurality of speakers and output the input signal to said plurality of speakers; and a speaker's face direction detecting device that detects a direction of a face of a person who is speaking based on frequency specific signal levels of input signals from said plurality of microphones, and wherein said speaker output adjusting device adjusts gains, delay times, and frequency characteristics for an input signal input from a microphone corresponding to the sound source position selected by said sound source position detecting device in accordance with at least one of distances between said microphone and respective ones of said plurality of speakers and the direction of the face detected by said speaker's face direction detecting device and output the input signal to said plurality of speakers.

2. A sound reinforcement system according to claim 1, wherein said plurality of microphones and said plurality of speakers are arranged at dispersed locations on a ceiling.

3. A sound reinforcement system according to claim 2, wherein said plurality of microphones and said plurality of speakers are arranged on a surface of the ceiling.

4. A sound reinforcement system according to claim 2, wherein said plurality of microphones and said plurality of speakers are suspended from said plurality of supporting sections provided on a surface of the ceiling.

5. A sound reinforcement system according to claim 1, wherein the gains and the delay times are set in proportion to distances from said microphone corresponding to the sound source position selected by said sound source position detecting device to respective ones of said plurality of speakers.

6. A sound reinforcement system comprising:

a plurality of microphones disposed in a room;

a plurality of speakers disposed in the room; and a speaker output adjusting device that outputs sound picked up by said plurality of microphones to said plurality of speakers at predetermined levels;

a sound source position detecting device that selects a microphone corresponding to a sound source position based on input signals from said plurality of microphones, and wherein said speaker output adjusting device adjusts gains and delay times for an input signal input from a microphone corresponding to the sound source position selected by said sound source position detecting device depending on distances between said microphone and respective ones of said plurality of speakers and output the input signal to said plurality of speakers, and wherein, when a microphone corresponding to a newly selected second sound source position is selected in the state in which said microphone corresponding to a first sound source position has been previously selected by said sound source position detecting device, an output level of a speaker located in a vicinity of said microphone corresponding to the newly selected second sound source position is lowered.

7. A sound reinforcement system comprising:

a plurality of microphones disposed in a room;

a plurality of speakers disposed in the room;

a speaker output adjusting device that outputs sound picked up by said plurality of microphones to said plurality of speakers at predetermined levels; and a directivity control device that sets directivity axes of sound emitted from respective ones of said plurality of speakers in directions opposite to a sound source direction.

8. A sound reinforcement system according to claim 7, further comprising a sound source position detecting device that detects a position of a sound source, and wherein said directivity control device controls directivity axes of sound emitted from the respective ones of said plurality of speakers to be oriented in directions opposite to the direction of the sound source detected by said sound source position detecting device.

9. A sound reinforcement system according to claim 7, wherein:

said plurality of microphones are arranged at dispersed locations on a ceiling;

the sound reinforcement system further comprises a sound source position detecting device that selects a microphone corresponding to a sound source position based on input signals from said plurality of microphones, and wherein said directivity control device controls directivity axes of sound emitted from the respective ones of said plurality of speakers to be oriented in directions opposite to the direction of said microphone corresponding to the sound source position selected by said sound source position detecting device.

10. A sound reinforcement system according to claim 9, wherein said sound source position detecting device is capable of selecting each of said plurality of microphones as a corresponding one of microphones corresponding to a plurality of sound source positions, and said directivity control device controls directivity axes of sound emitted from the respective ones of said plurality of speakers to be oriented in directions opposite to the directions of said respective microphones selected as the microphones corresponding to the plurality of sound source positions selected by said sound source position detecting device.

11. A sound reinforcement system according to claim 7, wherein said plurality of speakers each comprise a plurality of speaker units and is speaker array of which directivity is being controlled by controlling a signal for each of said speaker units, individually, and said directivity control device controls directivities of respective ones of said speaker arrays.

* * * * *